US009999896B2

(12) United States Patent
Ophardt et al.

(10) Patent No.: US 9,999,896 B2
(45) Date of Patent: Jun. 19, 2018

(54) PISTON PUMP WITH LOCKING PISTONS

(71) Applicant: OP-Hygiene IP GmbH, Niederbipp (CH)

(72) Inventors: Heiner Ophardt, Arisdorf (CH); Andrew Jones, St. Anns (CA)

(73) Assignee: OP-Hygiene IP GmbH, Niederbipp (CH)

( * ) Notice: Subject to any disclaimer, the term of this patent is extended or adjusted under 35 U.S.C. 154(b) by 0 days. days.

(21) Appl. No.: 15/645,149

(22) Filed: Jul. 10, 2017

(65) Prior Publication Data

US 2018/0015489 A1 Jan. 18, 2018

(30) Foreign Application Priority Data

Jul. 12, 2016 (CA) ..... 2935908

(51) Int. Cl.
*B05B 11/00* (2006.01)
*B67D 7/02* (2010.01)

(52) U.S. Cl.
CPC ..... *B05B 11/3059* (2013.01); *B05B 11/3004* (2013.01); *B05B 11/306* (2013.01); *B05B 11/3008* (2013.01); *B05B 11/3087* (2013.01); *B67D 7/0211* (2013.01)

(58) Field of Classification Search
CPC ..... B05B 11/3004; B05B 11/3008; B05B 11/3059; B05B 11/3087; B67D 7/0211
USPC ..... 222/153.13
See application file for complete search history.

(56) References Cited

U.S. PATENT DOCUMENTS 4,057,176 A * 11/1977 Horvath ..... B05B 11/0018 222/175
4,343,417 A 8/1982 Corsette
4,433,799 A * 2/1984 Corsette ..... B05B 11/3008 222/309
4,773,567 A * 9/1988 Stoody ..... B05B 11/3059 222/153.11
4,871,092 A * 10/1989 Maerte ..... B05B 11/3008 222/153.13
4,991,746 A * 2/1991 Schultz ..... A47K 5/1205 222/153.13
5,518,147 A * 5/1996 Peterson ..... B05B 11/3035 222/153.07

(Continued)

FOREIGN PATENT DOCUMENTS

JP 6227060 2/1987
WO 2008045820 4/2008

*Primary Examiner* — Nicholas J Weiss
(74) *Attorney, Agent, or Firm* — Thorpe North & Western LLP

(57) ABSTRACT

A piston pump with an improved arrangement by which a piston-forming element is movable relative to a piston chamber-forming element between locked and unlocked positions. The piston chamber-forming body has a collar member having an inner guide tube coaxially about an axis with a lug member extending radially inwardly therefrom and the piston-forming element has a slide tube coaxially radially inwardly of the collar member with the slide tube carrying motion control features for interaction and engagement with the lug member whereby relative axial and rotational movement of the piston-forming element relative to the piston chamber-forming body provides for the adoption of positions in which the pump is operable to dispense fluid and positions in which the pump is inoperative.

20 Claims, 35 Drawing Sheets

(56) References Cited

U.S. PATENT DOCUMENTS

| | | | | |
|---|---|---|---|---|
| 5,664,703 | A * | 9/1997 | Reifenberger | B05B 11/0016 222/207 |
| 5,899,363 | A * | 5/1999 | Bliss, III | B05B 11/0029 222/153.02 |
| 6,443,331 | B1 * | 9/2002 | DeJonge | B05B 11/00 222/153.13 |
| 6,626,330 | B2 | 9/2003 | Ritsche | |
| 6,695,171 | B2 * | 2/2004 | Walters | B05B 11/3001 222/153.13 |
| 7,735,688 | B2 | 6/2010 | Foster et al. | |
| 2002/0070238 | A1 * | 6/2002 | Pritchett | B05B 7/0037 222/189.11 |
| 2002/0190083 | A1 | 12/2002 | Ritsche | |
| 2007/0080173 | A1 * | 4/2007 | Coe | B05B 11/3059 222/153.13 |
| 2007/0080174 | A1 * | 4/2007 | Coe | B05B 11/3059 222/153.13 |

* cited by examiner

PISTON PUMP WITH LOCKING PISTONS

SCOPE OF THE INVENTION

This invention relates to a piston pump assembly having a piston-forming element coaxially mounted to a piston chamber-forming body for reciprocal axial movement to dispense product and in which the piston-forming element is movable between locked inoperative and unlocked operative positions by sequenced rotational and/or axial movement relative the piston chamber-forming body.

BACKGROUND OF THE INVENTION

Pumps for dispensing fluid product from containers are known to include piston pumps in which a piston is moved axially to discharge a fluid and in which the piston may be moved to a locked position in which the pump is inoperative as can be advantageous during shipping or handling.

A number of disadvantages arise with known lockable piston pumps. One disadvantage is that with many known pumps, the piston inadvertently moves out a locked position in shipping. Another disadvantage is that during the use of many known pumps, upon moving the piston from a locked to an unlocked position, the pump does not provide a tactical feeling to a user by which the user may understand that the piston has been moved between locked and unlocked positions. Another disadvantage with many known pumps is that a considerable number of components are required to provide a locking mechanism as contrasted with pumps that do not include a locking mechanism.

SUMMARY OF THE INVENTION

To at least partially overcome some of these disadvantages of known pumps, the present invention provides a piston pump with an improved arrangement by which a piston-forming element is movable relative to a piston chamber-forming element between locked and unlocked positions. Preferably, in accordance with the present invention, the piston chamber-forming body has a collar member having an inner guide tube coaxially about an axis with a lug member extending radially inwardly therefrom and the piston-forming element has a slide tube coaxially radially inwardly of the collar member with the slide tube carrying motion control features for interaction and engagement with the lug member whereby relative axial and rotational movement of the piston-forming element relative to the piston chamber-forming body provides for the adoption of positions in which the pump is operable to dispense fluid and positions in which the pump is inoperative.

Preferably, the slide tube has a side wall that has integrally formed therein a resilient finger member disposed circumferentially between a stop slot and a slide channel on the slide tube such that with rotation of the piston-forming element to appropriate axial positions relative to the piston chamber-forming member, the lug member moves between a position in the stop slot in which the pump is rendered inoperative, and a position in the slide channel in which axial movement for operation of the pump is permitted.

The finger member preferably is provided in the slide tube as a resilient member axially between two axially extending cut slots cut through the side wall of the slide tube with the finger member extending between the cut slots to a distal inner end.

Preferably, the provision of the finger member, the slide channel and the stop slot in the side tube wall reduces the number of components required for the pump.

In a first aspect, the present invention provides a liquid pump for dispensing a liquid from a container comprising:

a piston chamber-forming body having a cylindrical fluid chamber disposed about an axis and open at an axially outer end, a piston-forming element comprising a piston member and an actuator member, the piston member extending from the actuator member coaxially inwardly through the outer end of the fluid chamber into the fluid chamber and engaging the fluid chamber to form a liquid pump, the piston-forming element including a central axially extending stem with a passageway therethrough for passage of the liquid discharged by the liquid pump axially outwardly to a discharge outlet on the actuator member axially outwardly of the piston chamber-forming body, wherein in coaxial reciprocal movement of the piston-forming element relative the piston chamber-forming body about the axis between a retracted axial position and an extended axial position, the liquid pump dispenses liquid from the container out the discharge outlet 36, the piston chamber-forming body including a collar member for engagement with an opening of the container, the collar member having an inner guide tube coaxially about the axis open at both an axially inner end and an axial outer end, the guide tube having a cylindrical radially inwardly directed inner guide surface, a lug member extending radially inwardly from the inner guide surface, the lug member extending radially inwardly from the inner guide surface over a circumferential extent C, a radial extent R, and an axial extent A, the piston-forming element having an outer slide tube fixed to the actuator member at an axially outer end and extending axially inwardly to an open axial inner slide tube end, the slide tube coaxially about the piston member radially outwardly about the piston member, the slide tube having a radially outwardly directed outer tubular slide tube wall, a pair of axially extending circumferentially spaced cut slots, each cut radially through the slide tube wall from a respective inner slot end open to the inner slide tube end to a respective blind outer slot end located spaced axially outwardly from the inner slide tube end, a first finger member defined in the slide tube wall between the cut slots with the first finger member extending from an axially inner distal end of the first finger member to an axially outer end of the first finger member where the first finger member merges into the slide tube wall between the outer slot ends, the first finger member deflectable by radially inwardly directed forces to move the distal end radially inwardly relative the slide tube wall, the slide tube having an axially extending first slide channel extending radially inwardly from the slide tube wall, the first slide channel and the lug member complementarily sized in circumferential extent and radial extent such that when the slide tube is rotated about the axis relative the guide tube to a first operative rotational position, the lug member slides axially in the first side channel permitting relative coaxial sliding between the retracted position and the extended position for operation of the liquid pump to dispense the liquid, the slide tube having an axially extending first stop slot extending radially inwardly into the slide tube wall, the first stop slot and the lug member complementarily sized in circumferential extent and radial extent such that when the slide tube is rotated about the axis relative the guide tube to a first inoperative rotational position, the lug member is received in the first stop slot and engagement between the slide tube and the guide tube limits relative coaxial sliding to prevent operation of the liquid pump to dispense the liquid, the first finger member located on the slide tube circumferentially between the first slide channel and the first stop slot, in relative rotation of the guide tube and the slide tube about the axis from the first inoperative rotational position to the first operative rotational position, the first finger member blocks the circumferential movement of the lug member until with relative rotation about the axis, a camming surface of the lug member and a cammed surface on the first finger member engage deflecting the first finger member radially inwardly out of the path of the lug member permitting the lug member to rotate circumferentially therepast from the first inoperative rotational position to the first operative rotational position.

BRIEF DESCRIPTION OF THE DRAWINGS

Further aspects and advantages of the present invention will occur from the following description taken together with the accompanying drawings in which.

DETAILED DESCRIPTION OF THE DRAWINGS

Figure 1:
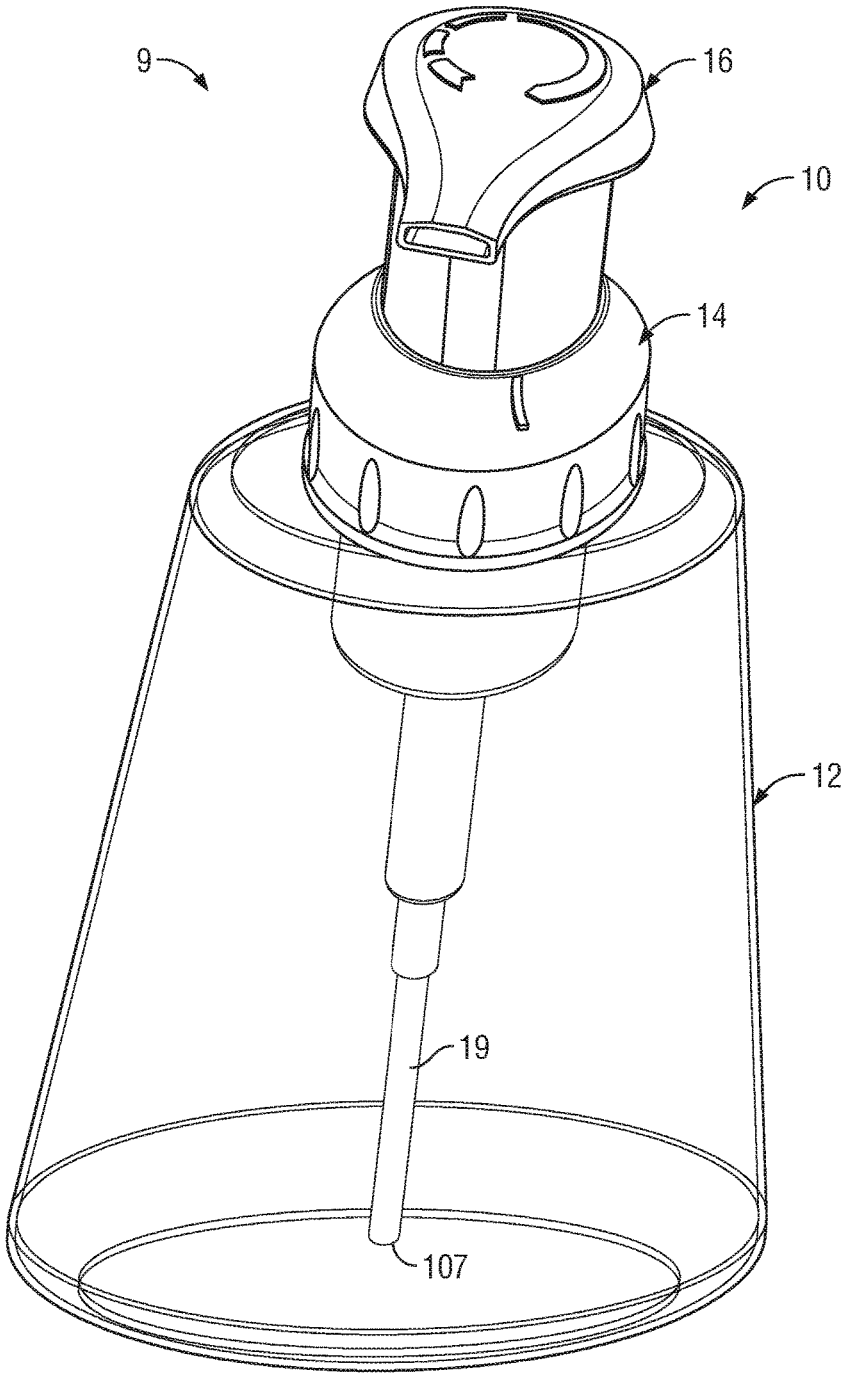
FIG. 1 is a pictorial view of a fluid dispenser with a pump assembly in accordance with the present invention in a locked condition.
Figure 2:
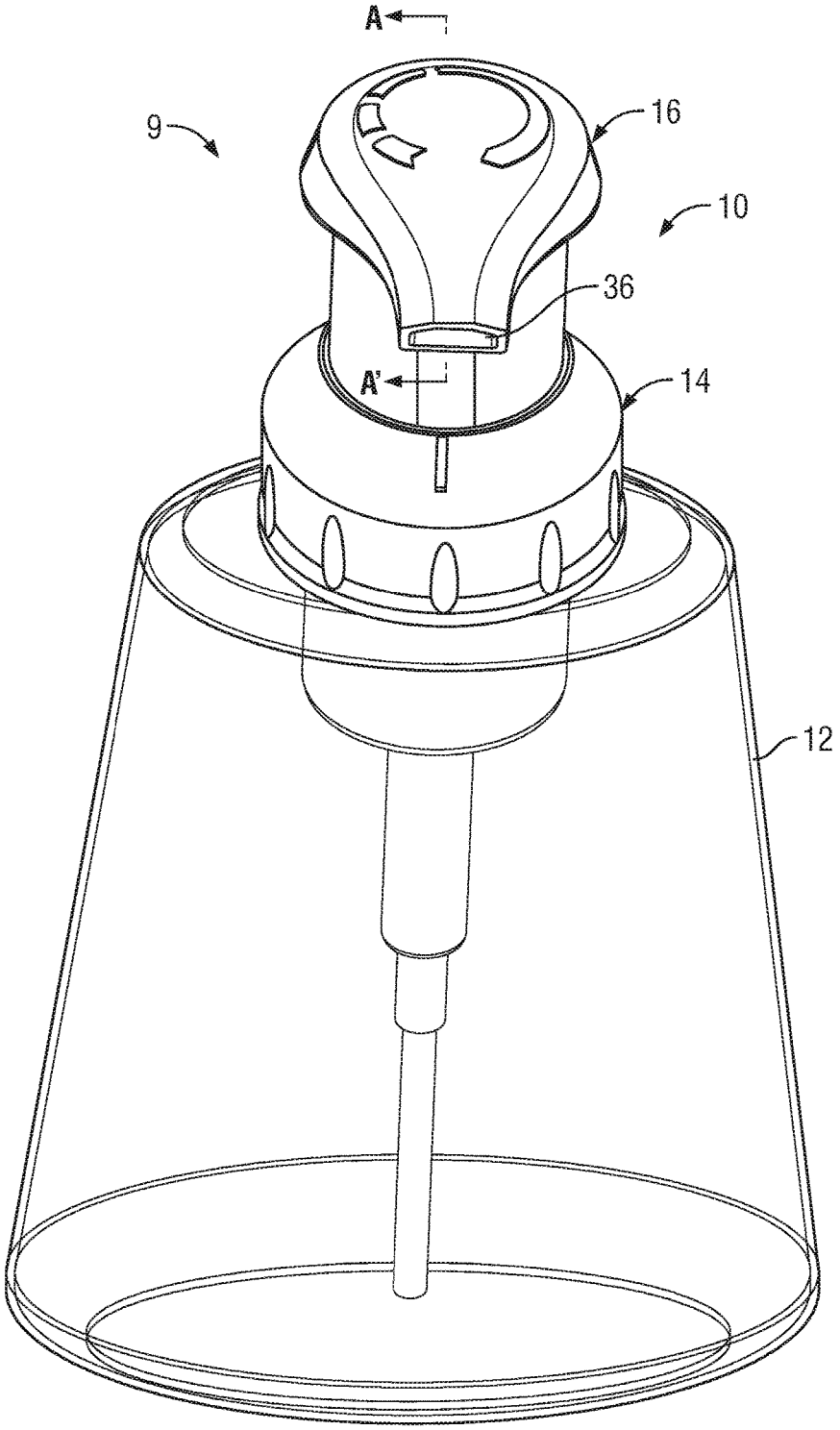
FIG. 2 is a pictorial view of the dispenser of FIG. 1 with the pump assembly in an unlocked extended position.
Figure 3:
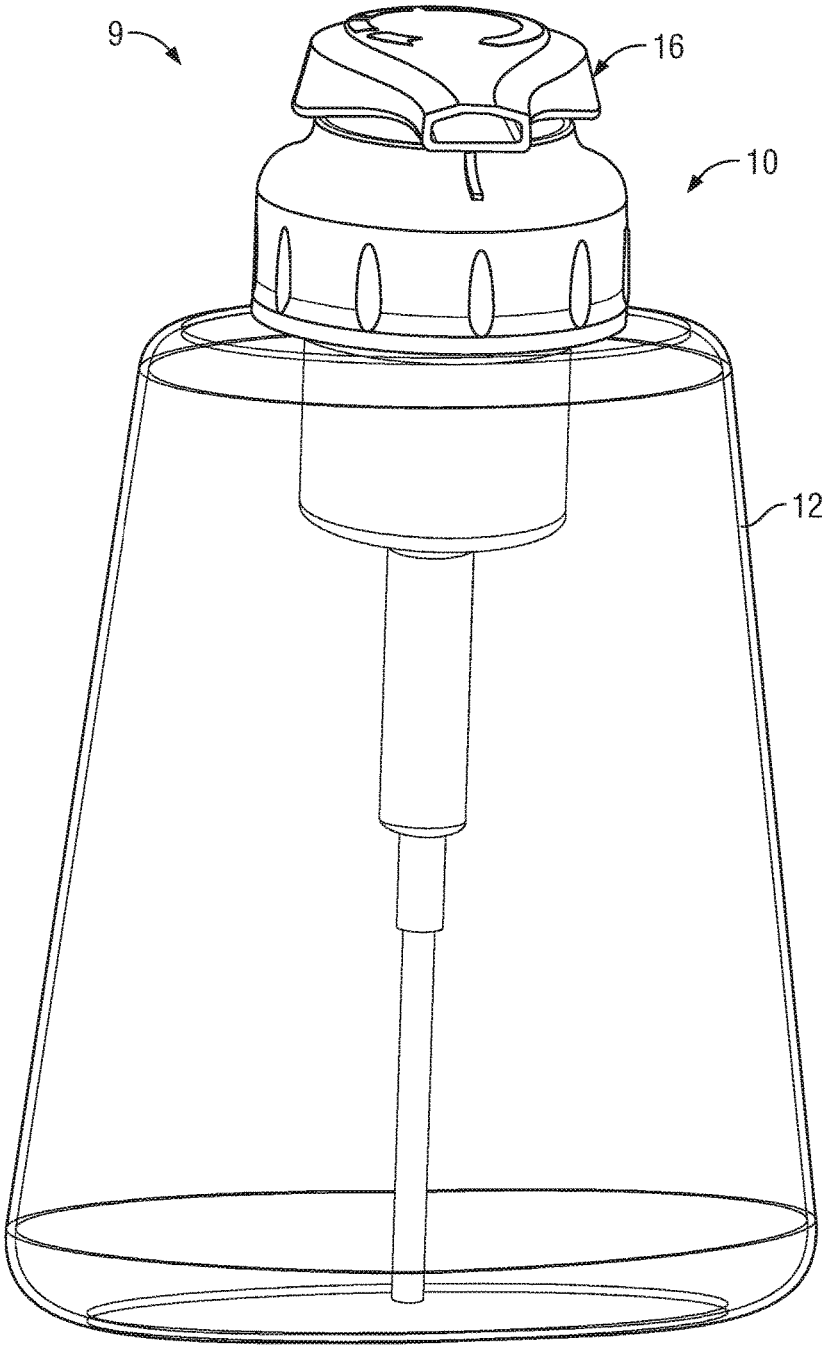
FIG. 3 is a pictorial view of the dispenser of FIG. 1 with the pump assembly in an unlocked retracted condition.

Reference is made to FIGS. 1 to 23 showing a first embodiment of a dispenser 9 in accordance with the present invention. The dispenser 9 includes a pump assembly 10 and a container 12. In FIGS. 1, 2 and 3, for ease of illustration, the container 12 is illustrated as being transparent.

Figure 4:
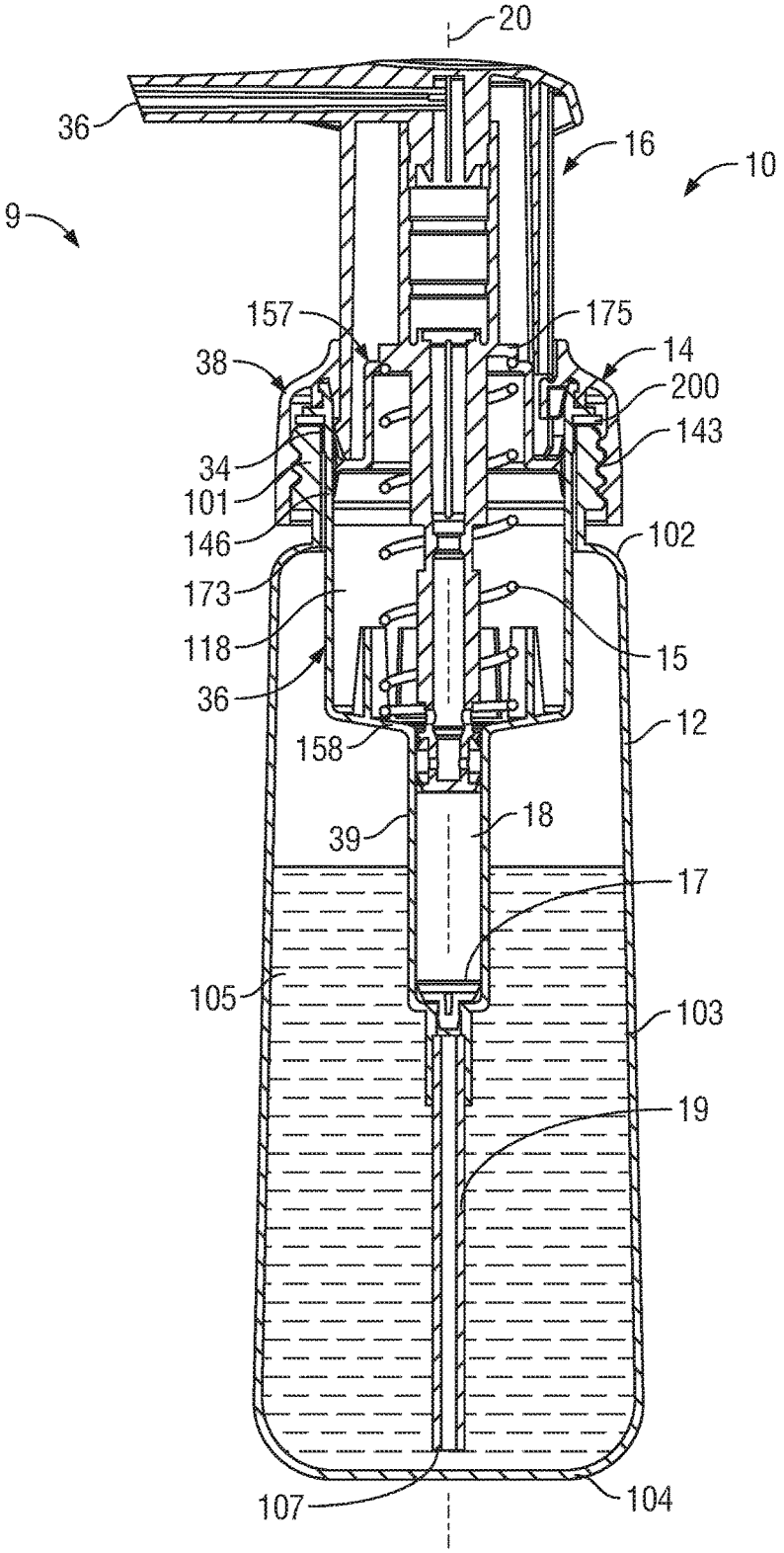
FIG. 4 is a cross-sectional side view through the dispenser of FIG. 2 along section line A-A' including a central axis through the pump assembly.

The container 12 is enclosed but for an opening 37, as seen in FIG. 4, provided at an axially outer end of a threaded neck 101 of the container which is coupled to a top wall 102 of the container 12. The top wall 102 merges into a side wall 103 and, hence, into a bottom wall 104. As illustrated in FIG. 4, a liquid 105 is contained within the container 12 and the pump assembly 10 is adapted to discharge the liquid 105 from container 12.

As seen in the cross-section of FIG. 4, the pump assembly 10 has a piston chamber-forming body 14 and a piston-forming element 16. Each of the piston chamber-forming body 14 and the piston-forming element 16 are substantially disposed coaxially about a central axis 20. When the pump assembly 10 is in an unlocked configuration, coaxial reciprocal movement of the piston-forming element 16 relative the piston chamber-forming body 14 about the axis 20 between an axially extended position as shown in FIGS. 2, 4 and 5 and an axially retracted position shown in FIGS. 3 and 6, dispenses the liquid 105 from the container 12 out a discharge outlet 36 of the piston-forming element 16.

Figure 5:
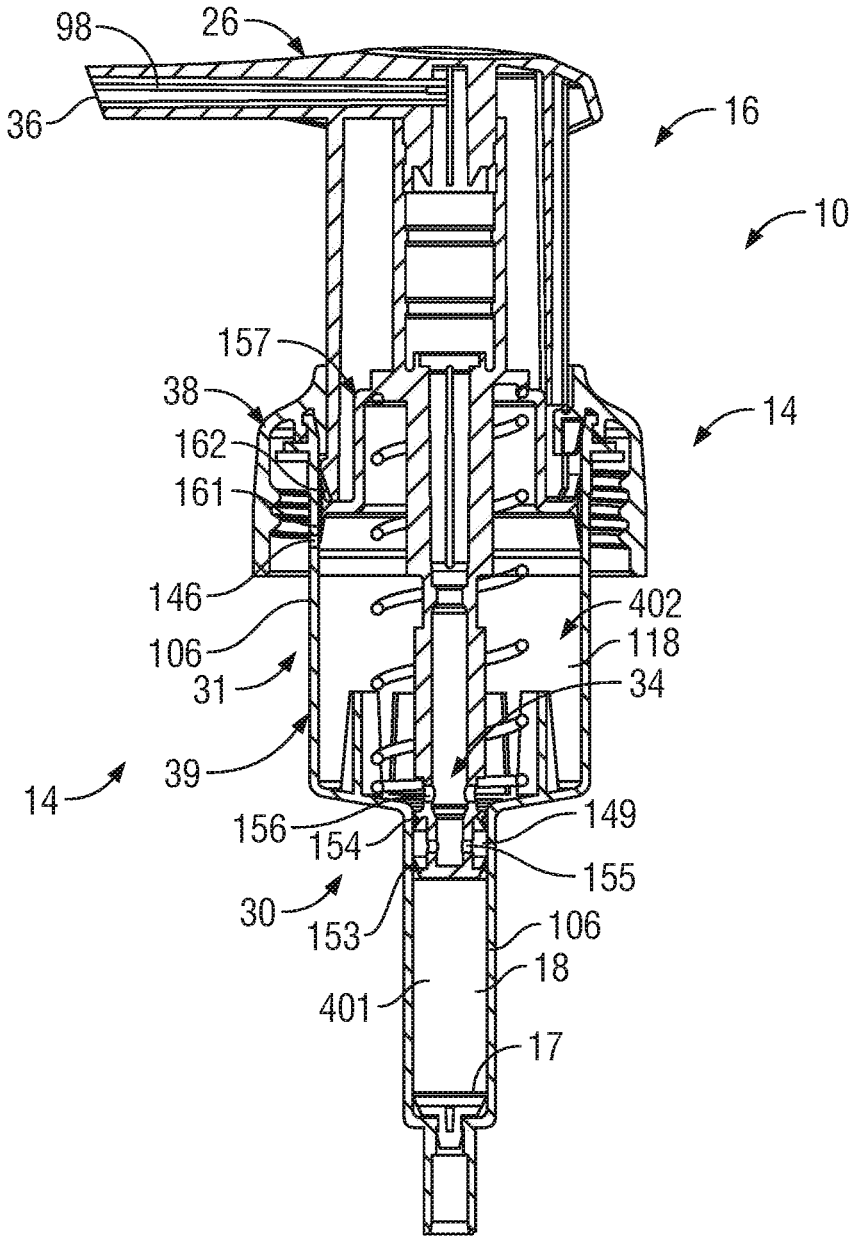
FIG. 5 is an enlarged cross-sectional side view of the pump assembly as shown in FIG. 4.
Figure 9:
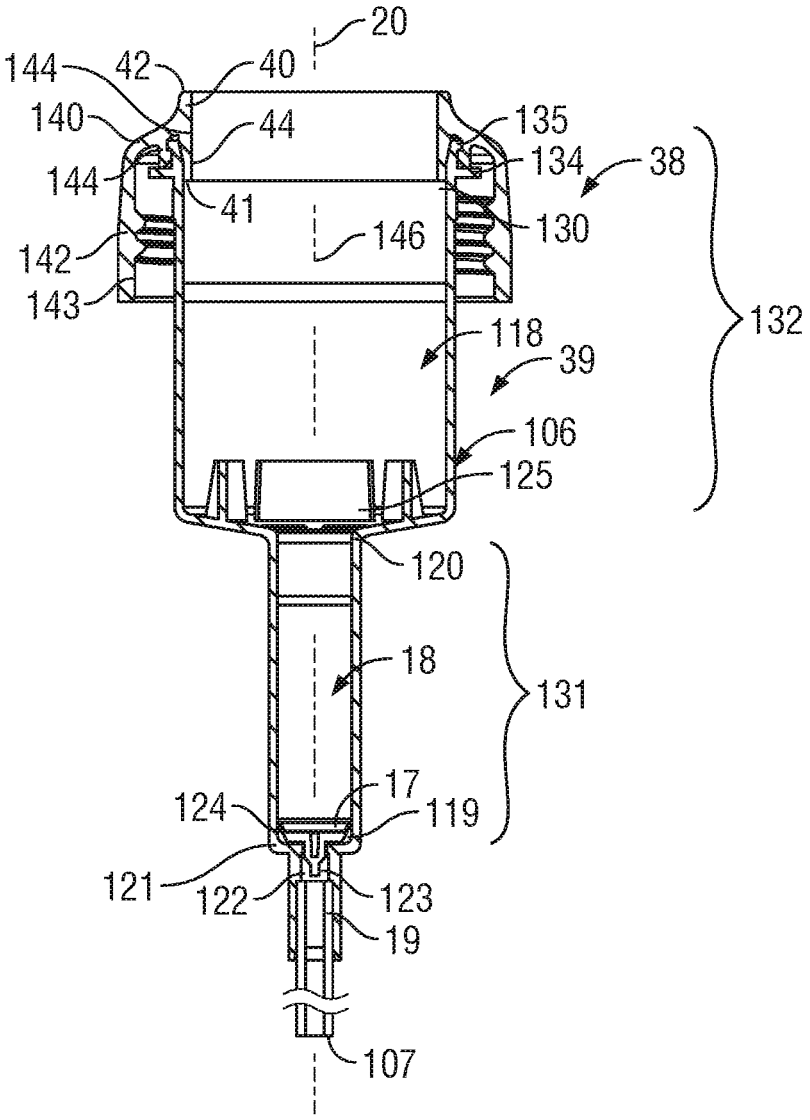
FIG. 9 is a cross-sectional side view of the piston chamber-forming element as seen in FIG. 4.

The piston chamber-forming body 14, as seen in FIGS. 5 and 9, comprises two major components, a collar member 38 and a tube member 39 which are fixedly secured together in a snap fit relation. The piston-forming element 16 includes as two lesser elements a one-way inlet valve 17 and a dip tube 19.

The tube member 39 has a side wall 106 disposed coaxially about the axis 20 with a generally stepped configuration so as to define an axially inner fluid chamber 18 and an axially outer air chamber 118.

Figure 8:
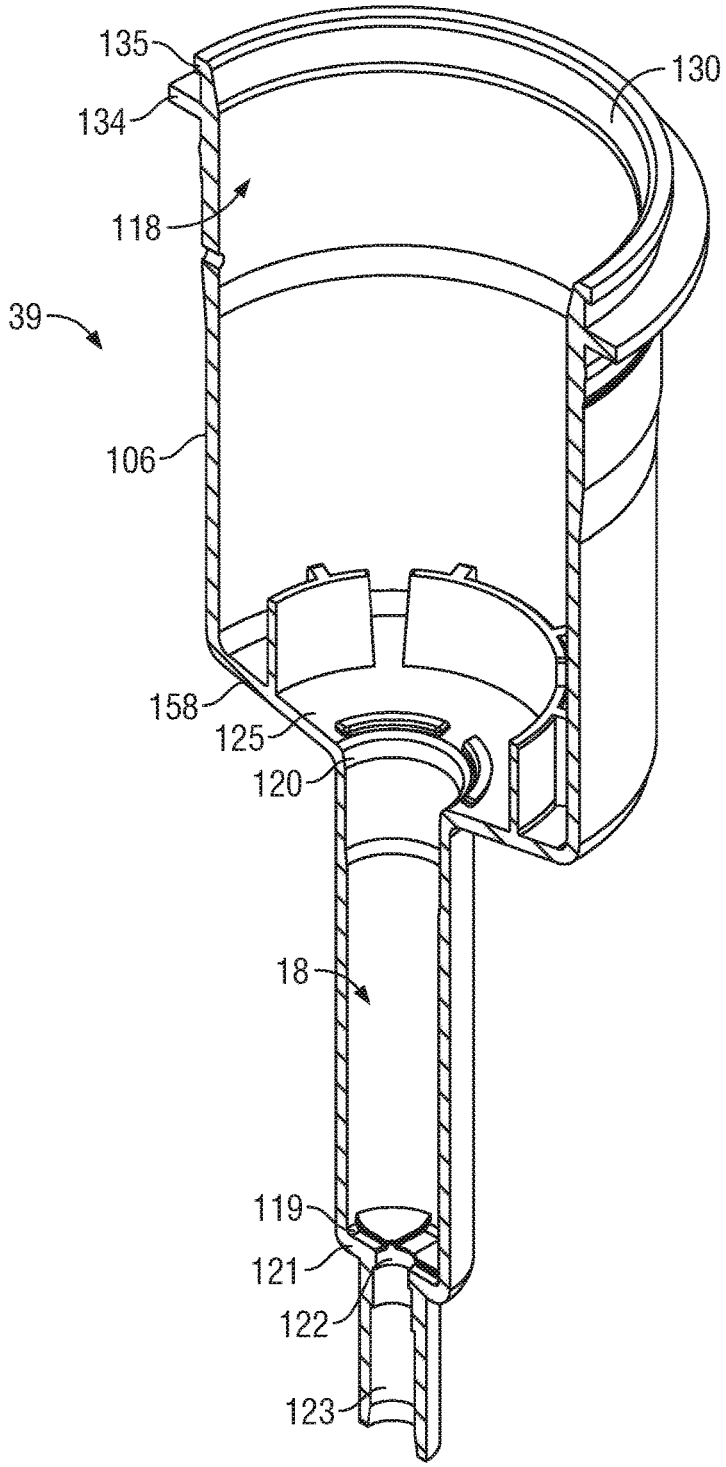
FIG. 8 is a pictorial cross-sectional view along section line A-A' in FIG. 2 of a tube member of the piston chamber-forming body of the pump assembly of FIG. 4.

The fluid chamber 18 is defined inside the wall 106 from an axially inner end 119 to an axially outer end 120 of the fluid chamber 18. The axially inner end 119 is defined by a radially inwardly extending shoulder 121 with an inlet opening 122 coaxially therethrough opening axially inwardly into a socket 123 open axially inwardly. The socket 123 is adapted to frictionally receive an inner end of the dip tube 19. The hollow tubular dip tube 19 extends downwardly to a lower end 107 disposed approximate the bottom wall 104 of the container 12. The one-way inlet valve 17 is secured in the inlet opening 122 in a snap fit and includes a resilient disc 124 that engages the radially inwardly directed inner surface of the wall 106 to permit fluid flow axially outwardly therepast yet to prevent fluid flow axially inwardly therepast as in a manner, for example, described in a similar one-way inlet valve in U.S. Pat. No. 5,676,277 to Ophardt issued Oct. 14, 1997, the disclosure of which is incorporated herein by reference. The fluid chamber 18 is open at its axially outer end 120 into an inner end 125 of the air chamber 118. The air chamber 118 is defined within the wall 106 between its axially inner end 125 and an axially outer end 130. Thus, the fluid chamber 118 is open at its axially inner end 120 into the air chamber 118. The air chamber 118 is open axially outwardly at its axially outer end 130. The fluid chamber 118 is defined between its axially inner end 119 and its axially outer end 120 radially inwardly of an inner portion 131 of the wall 106 which is circular in cross-section, substantially cylindrical and has a diameter. The air chamber 118 is defined between its axially inner end 125 and its axially outer end 130 by an outer portion 132 of the wall 106 which is circular in cross-section, substantially cylindrical and has a diameter larger than the diameter of the inner wall portion 131 forming the fluid chamber 18. As best seen in FIG. 8, the wall 106 carries at the outer end 130 a radially outwardly extending snap flange 135 and spaced axially inwardly from the snap flange 135, a radially outwardly extending sealing flange 134.

As seen in FIGS. 5 and 9 the collar member 38 is secured in a fixed snap fit relation on to the axially outer end 130 of the tube member 39. The collar member 38 has an inner guide tube 40 coaxially about the axis 20. The inner guide tube 40 is open both at an axially inner end 41 and an axially outer end 42. The guide tube 40 has a cylindrical radially inwardly directed inner guide surface 44 extending between its inner end 41 and its outer end 42. The collar member 38 includes a radially outwardly extending shoulder flange 140 merging into an outer collar tube 142 having a threaded radially inwardly directed surface 143 carrying threads for engagement with complementary threads on the threaded neck 101 of the container 12. Between the inner guide tube 40 and the outer collar tube 142, an axially extending snap tube 144 extends axially inwardly from the shoulder flange 140. As seen in FIG. 9, the snap flange 135 on the collar member 38 carries an axially inwardly directed shoulder for engagement with an axially outwardly directed shoulder on the snap tube 144 to fixedly secure the collar member 38 and the tube member 39 coaxially about the axis 20 with the inner guide tube 40 disposed radially inwardly of the wall 106 of the tube member 39 about the outer end 130. As can be seen in FIG. 4, the collar member 38 is secured to the container 12 with the threaded surface 143 of the collar member 38 engaging the threaded neck 101 on the container 12 and urging the sealing flange 134 of the tube member 38 into sealed engagement with the opening 37 of the container 12, preferably with a resilient annular gasket member 200 disposed axially therebetween.

Figure 7:
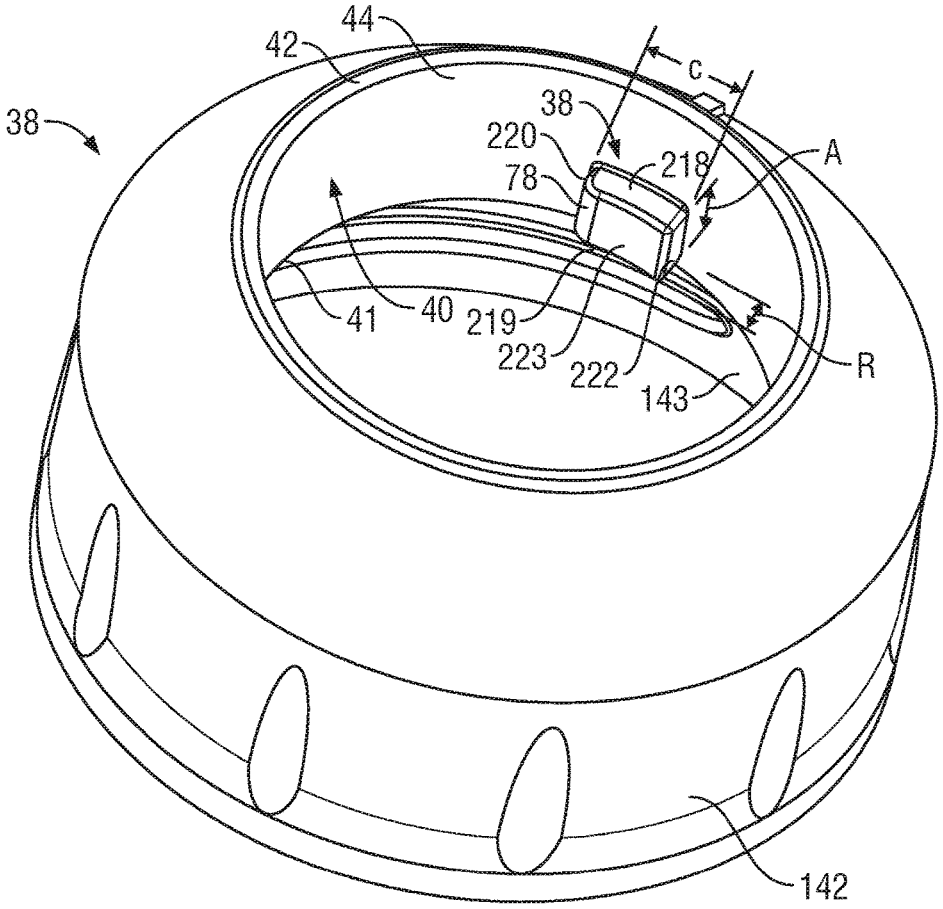
FIG. 7 is a pictorial view with a collar member of the pump assembly in FIG. 4.

Referring to FIG. 7 showing the collar member 38, the inner guide tube 40 carries a lug member 46 that extends radially inwardly from the inner guide surface 44. The lug member 38 as seen in FIG. 7 has an axially outwardly directed outer axial lug stop surface 218, an axially inwardly directed inner axial lug stop surface 219, a circumferentially directed right lug side surface 220, a circumferentially directed left lug side surface 222, and a radially inwardly directed circumferential lug surface 223. The lug member 28 provides as curved merger of the right lug side surface 220 and the circumferential lug surface 223, a camming surface 78. The lug member 46 is marked on FIG. 7 to extend radially inwardly from the inner guide surface 44 over a circumferential extent C between the right lug side surface 220 and the left lug side surface 22, a radial extent R from the inner guide surface 44 to the circumferential lug surface 223 and an axial extent A between the outer axial lug stop surface 218 and the inner axial lug stop surface 219.

Figure 10:
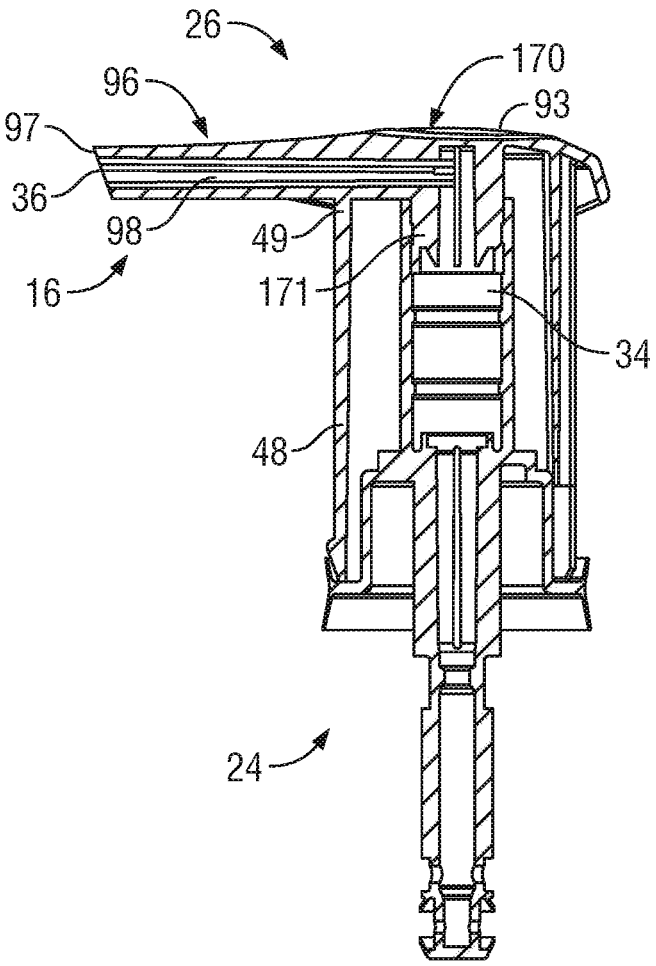
FIG. 10 is a cross-sectional side view of the piston-forming element as seen in FIG. 4.
Figure 11:
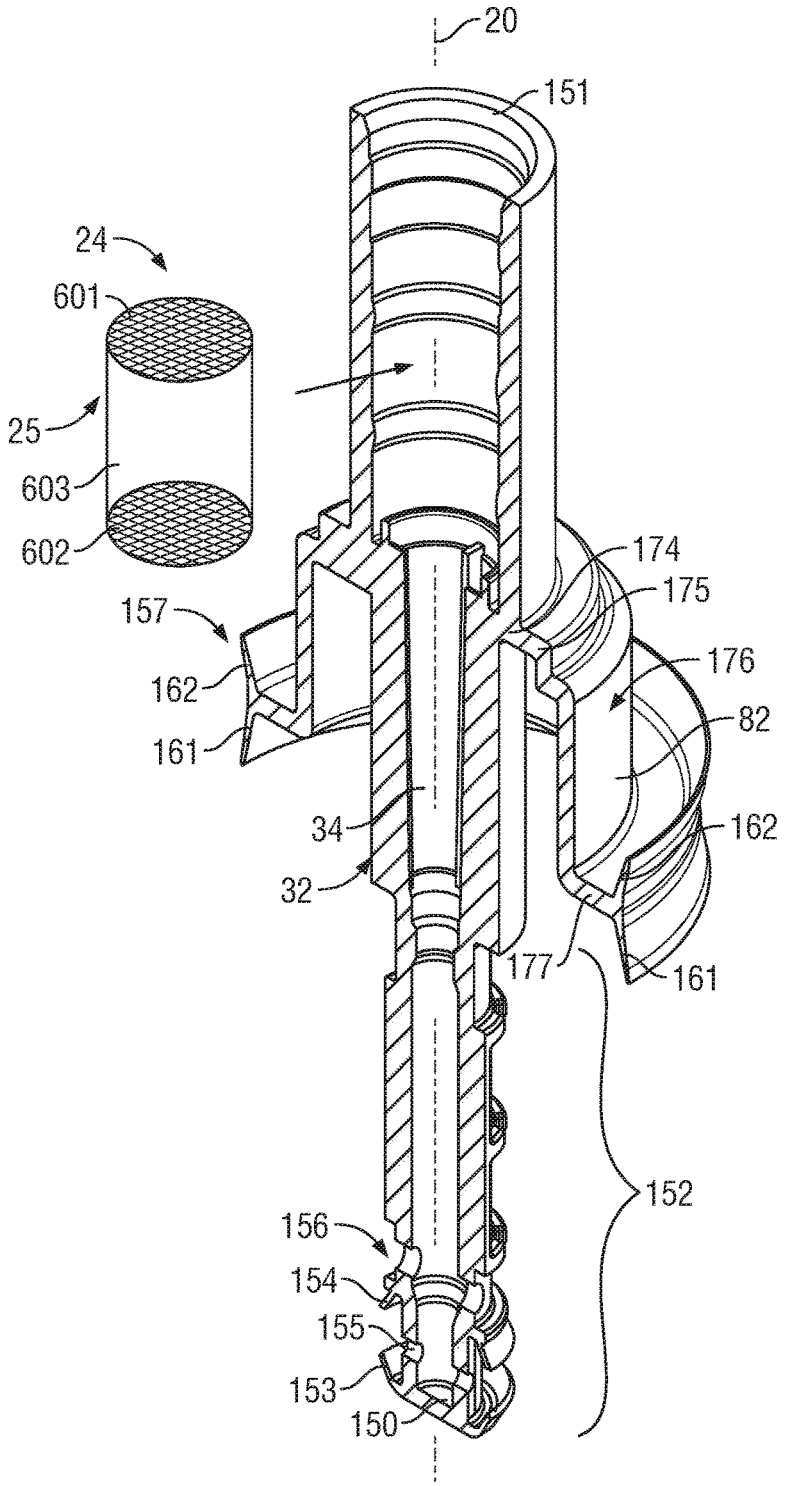
FIG. 11 is a pictorial cross-sectional side view along section line A-A' in FIG. 2 of the piston member of the piston chamber-forming body shown in FIG. 10.
Figure 12:
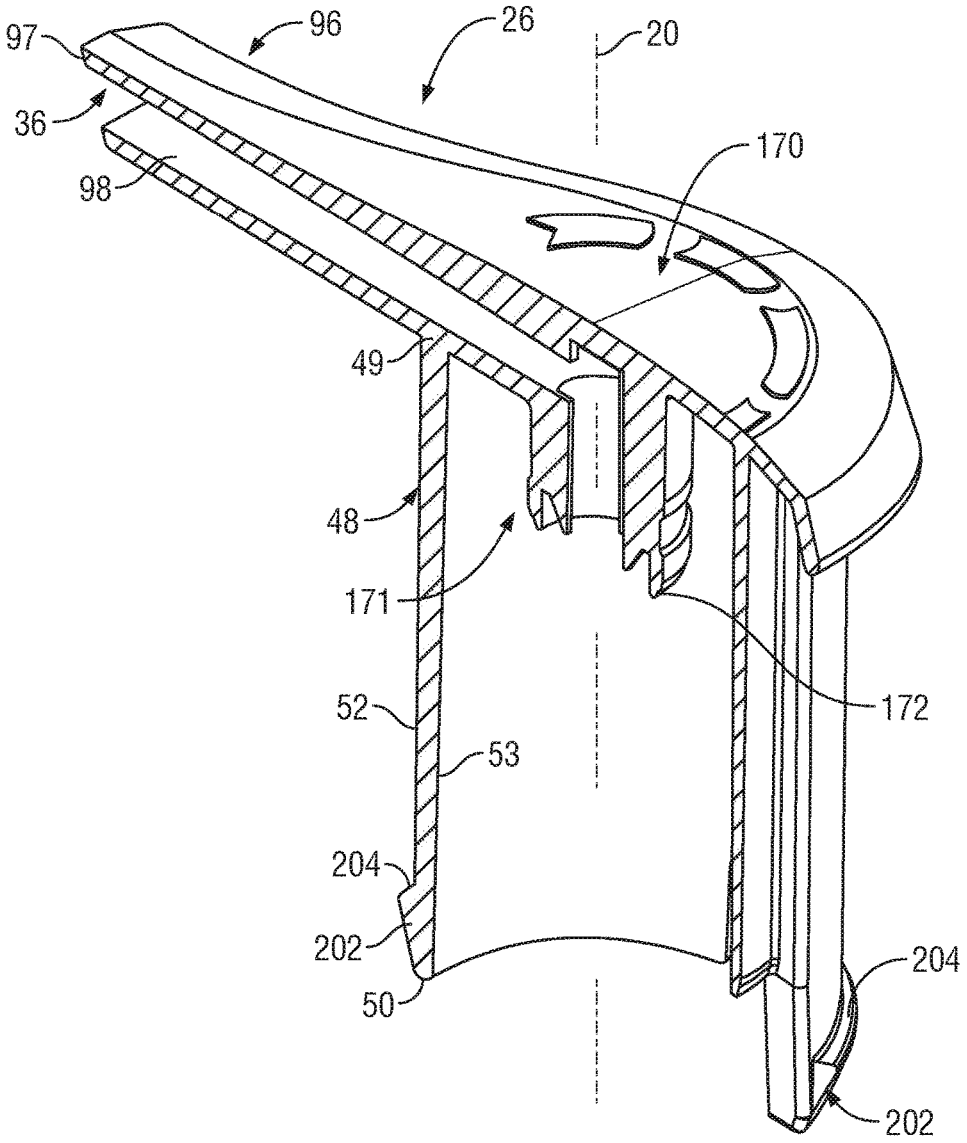
FIG. 12 is a pictorial cross-sectional side view along section line A-A' in FIG. 2 of the actuator member of the piston-forming element shown in FIG. 10.

Reference is made to FIGS. 10 to 12 showing the piston-forming element 16 as comprising two major elements, namely, a piston member 24 and an actuator member 26. In addition, as a minor element, the piston-forming element 16 includes a foam generator 25 schematically illustrated in FIG. 11.

The foam generator 25 is schematically illustrated as a cylindrical member comprising a pair of spaced screens 601, 602 bonded to the axial ends of a cylindrical porous sponge-like plug. The particular nature of the foam generator 25 is, however, not limited. The foam generator 25 is adapted to be received within the passageway 34 axially inwardly from an inner stem tube 170 on the actuator member 26 and supported on a radially outwardly directed shoulder within the passageway 34. The particular nature of a foam generator 25 is not limited and the purpose of the foam generator is to generate a consistent mixture of a foamed air and liquid product on simultaneous passing of the air and liquid therethrough.

The piston member 24 is best seen by itself in FIG. 11 as being disposed coaxially about the axis 20. The piston-forming element 16 includes a central axially extending stem 32 with a passageway 34 therethrough closed at an axially inner end 150 and open at an axially outer end 151. The piston member 24 carries a reduced diameter axially innermost fluid piston portion 152 which is adapted to be coaxially received within the fluid chamber 18 to form a liquid pump 30. The fluid piston portion 152 includes a resilient inner disc 153 that engages the side wall 106 in the fluid chamber 118 to permit fluid flow axially outwardly therepast but to prevent fluid flow axially inwardly therepast. The fluid piston portion 152 includes an outer disc 154 that engages the side wall 106 in the fluid chamber 18 to prevent fluid flow axially therepast. Liquid ports 155 located on the stem 32 between the outer disc 154 and the inner disc 153 extend coaxially through the stem 32 into the passageway 34. With reciprocal coaxial movement of the piston member 24 relative to the tube member 39, the fluid 105 is drawn upwardly from the container 12 though the dip tube 19 past the one-way inlet valve 17 into the fluid chamber 18 in a retraction stroke and in an opposite extension stroke, the fluid 105 is discharged axially outwardly past the inner disc 153 into an annular space 149 radially outward of the stem 32 and radially inward of the wall 106 and between the inner disc 153 and the outer disc 154 and hence via the liquid ports 155 radially through the stem 32 into the passageway 34 leading to the discharge outlet 36. The operation of the liquid pump 30 is substantially the same as described in U.S. Pat. No. 5,676,277 to Ophardt referenced above. However, many other configurations of a piston pump may be adopted for the liquid pump 30 without departing from the present invention.

In the liquid pump 30, there is defined between the outer disc 54 and the one-way inlet valve 17, a liquid compartment 401 with a volume that varies with the axial position of the piston member 24 within the fluid chamber 18.

Axially outwardly on the stem 32 from the outer disc 154, transfer ports 156 are provided radially through the stem 32 into the passageway 34. Axially outwardly from the transfer ports 156, an annular air disc 157 extends radially outwardly from the stem 32. The air disc 157 extends radially from stem 32 at an axially outer end 174 of the air disc 157 as a radial shoulder 175 that bridges between the stem 32 and a generally cylindrical tubular portion 176 of the air disc 157. The tubular portion 176 extends coaxially about the axis 20 from the radial shoulder 175 axially inwardly to merge with at an axially inner end with the radially outwardly flange 177 carrying disc arms 161 and 162.

As can be seen in FIG. 5, the air disc 157 at its radial outer end carries the pair of resilient disc arms 161 and 162 which engage the inner surface of the wall 106 inside the air chamber 118 to provide a seal preventing flow axially inwardly or outwardly therepast.

An air compartment 402 is defined annularly about the stem 32 radially between the stem 32 and the wall 106 about the air chamber 118 and axially between the air disc 157 and the outer disc 154. The air compartment 402 has a volume that varies with the axial position of the piston member 24 within the tube member 39 whereby an air pump 31 is formed. In a retraction stroke, the volume of the air compartment 402 decreases forcing air through the transfer port 156 into the passageway 34 simultaneously with the discharge of the liquid 105 from the pump liquid 30 into the passageway 34 for simultaneous discharge of air and liquid via the passageway 34 through the foam generator 25 to produce a foam of air and the liquid that is discharged to the discharge outlet 36. In a withdrawal stroke, the volume of the air compartment 402 increases drawing via the discharge outlet 36 air from the atmosphere, as well as drawing any foam, air or liquid within the passageway 34 into the air compartment 402.

A spring member 15 is disposed with the air chamber 118 engaged at an axially inner end of the spring member 15 on a radially extending shoulder 158 between the outer end 120 of the fluid chamber 18 and the inner end 125 of the air chamber 118 and at an axially inner end and at an axially outer end of the spring member 15 on the shoulder flange 175 the air disc 157. The spring member 15 biases the piston member 24 and thereby the piston-forming element 16 axially outwardly relative to the piston chamber-forming body 14 to the extended position as shown in FIG. 5 and is compressible to permit the piston-forming element 16 to be moved relative the piston chamber-forming body 14 from the extended position of FIG. 5 to the retracted position of FIG. 6.

Reference is made to FIG. 12 showing the actuator member 26 alone. The actuator member 26 includes at an axially outer end a radially extending endcap 170 from which an outer slide tube 48 extends axially inwardly from an axially outer end 49 of the outer slide tube 48 to an open axially inner slide tube end 50. The slide tube 48 extends coaxially about the axis 20 axially inwardly from the end cap 170. An inner stem tube 171 also extends coaxially about the axis 20 from the endcap 170 coaxially within the outer slide tube 48 to an axially inner end 172 of the inner stem tube 171. The actuator member 26 carries a radially outwardly extending discharge tube 96 that extends radially outwardly from the end cap 170 and carries the discharge outlet 36 at a radially outer end 97. An internal passage 98 extends radially through the discharge tube 96 to provide for communication between the discharge outlet 36 and the passageway 34 in the stem 32.

Figure 6:
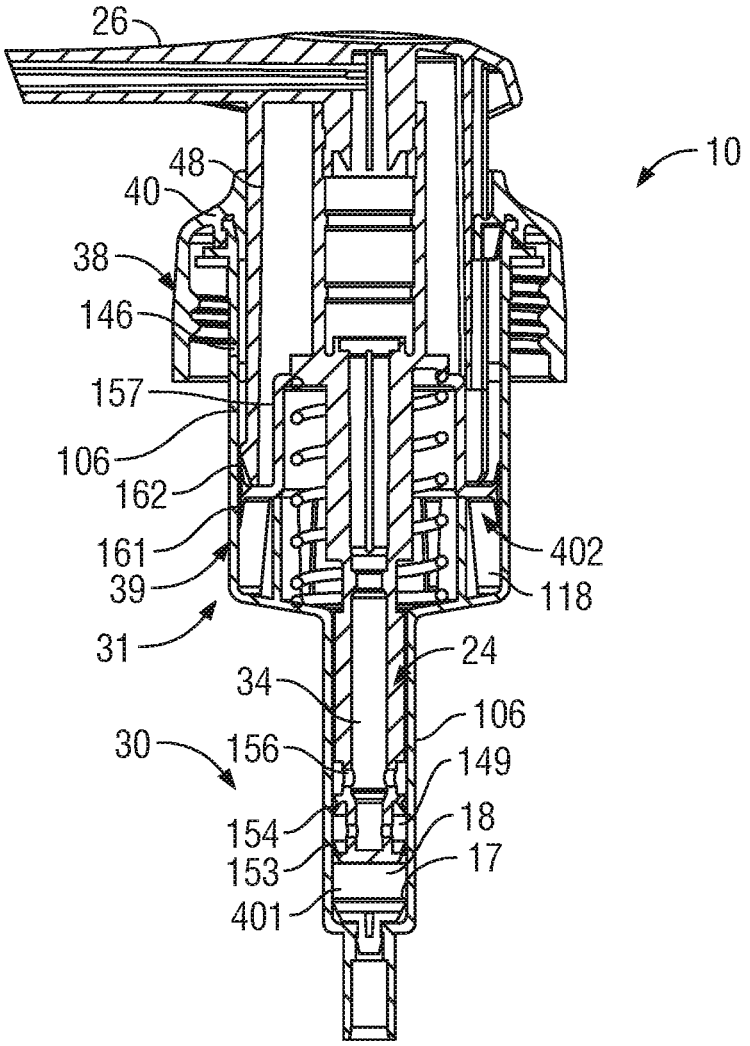
FIG. 6 is a cross-sectional side view same as FIG. 5, but showing the pump assembly in the retracted position as in FIG. 3.

As can be seen in FIG. 10, the piston member 24 and the actuator member 26 are fixedly secured together with the inner stem tube 171 coaxially within the open outer end of the passageway 34 of the stem 32 of the piston member 24 in frictional engagement. The end cap 170 of the actuator member 26 provides an axially outer end of the actuator member 26 as an axially outwardly directed engagement surface 93 for the application of manual forces to move the piston-forming element 16 relative the piston chamber-forming body 14 axially from the extended position as seen in FIG. 5 to the retracted position such as seen in FIG. 6.

As can be seen in FIGS. 5 and 9, an air port 146 is provided radially through the wall 106 into the air chamber 118. Reference is made to FIG. 4 which illustrates the air port 146 as open on a radial outward side of the tube member 36 via an annular passageway 173 between the tube member 39 and the neck 101 of the container 12 into the interior of the container 12. When the piston-forming element 16 is in an extended position as seen in FIGS. 4 and 5, the disc arms 161 and 162 on the air disc 157 overly the air port 146 and prevent flow through the air port 146. However, on the piston-forming element 16 being moved axially inwardly relative to the piston chamber-forming body 14 from the extended position of FIGS. 4 and 5, once the disc arm 162 on the air disc 157 is moved axially inwardly of the air port 146, then the radial inward side of the air port 146 is open to atmospheric air via axially extending annular spacings between the slide tube 48 of the actuator member 26 and each of the side wall 106 of the tubular member 29 and the inner guide tube 40 of the collar member 38. This communication of the air port 146 with the atmosphere provides for equalization of pressure between the atmosphere and the interior of the container 12 as will relieve any vacuum which may be developed in the interior of the container 12 due to the removal of the fluid 105 from the container 12 by the liquid pump 30.

Reference is made to FIGS. 12, 13, 14 and 15 showing the actuator member 26 alone. As can be seen in FIG. 12, the actuator member 26 carries the slide tube 48 which has a radially outwardly directed outer tubular slide tube wall 52 and a radially inwardly directed inner tubular slide tube wall 53. The outer slide tube wall 52 is circular in any cross-section normal the axis 20. Similarly, the inner slide tube wall 53 is circular in any cross-section normal the axis 20. The slide tube 48 carries approximate its inner slide tube end 50 a radially outwardly extending annular end flange 202 presenting an axially outwardly directed stop shoulder 204.

Figure 15:
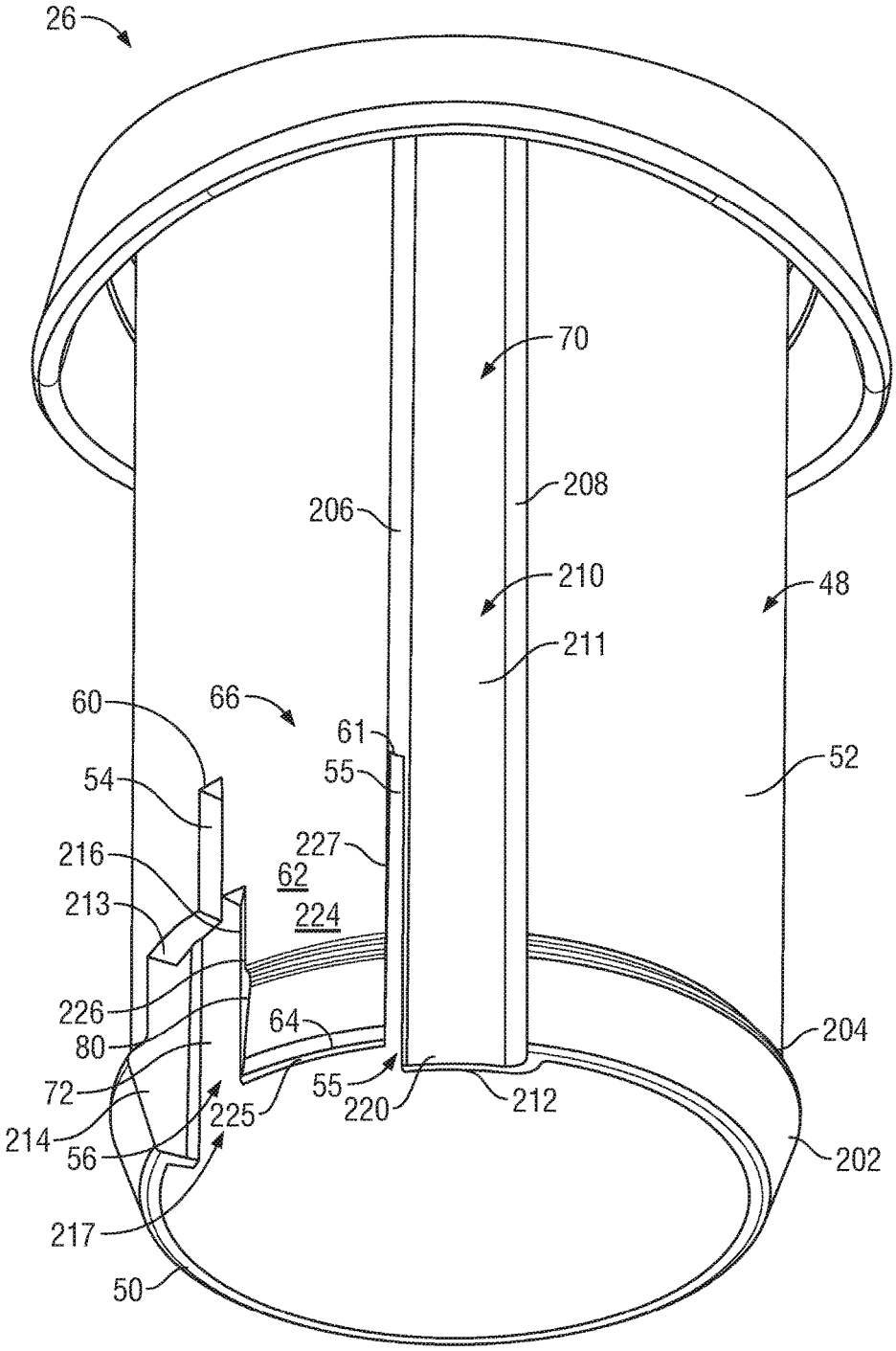
FIG. 15 is a pictorial rear view of the actuator member of FIG. 12 as seen from below.
Figure 16:
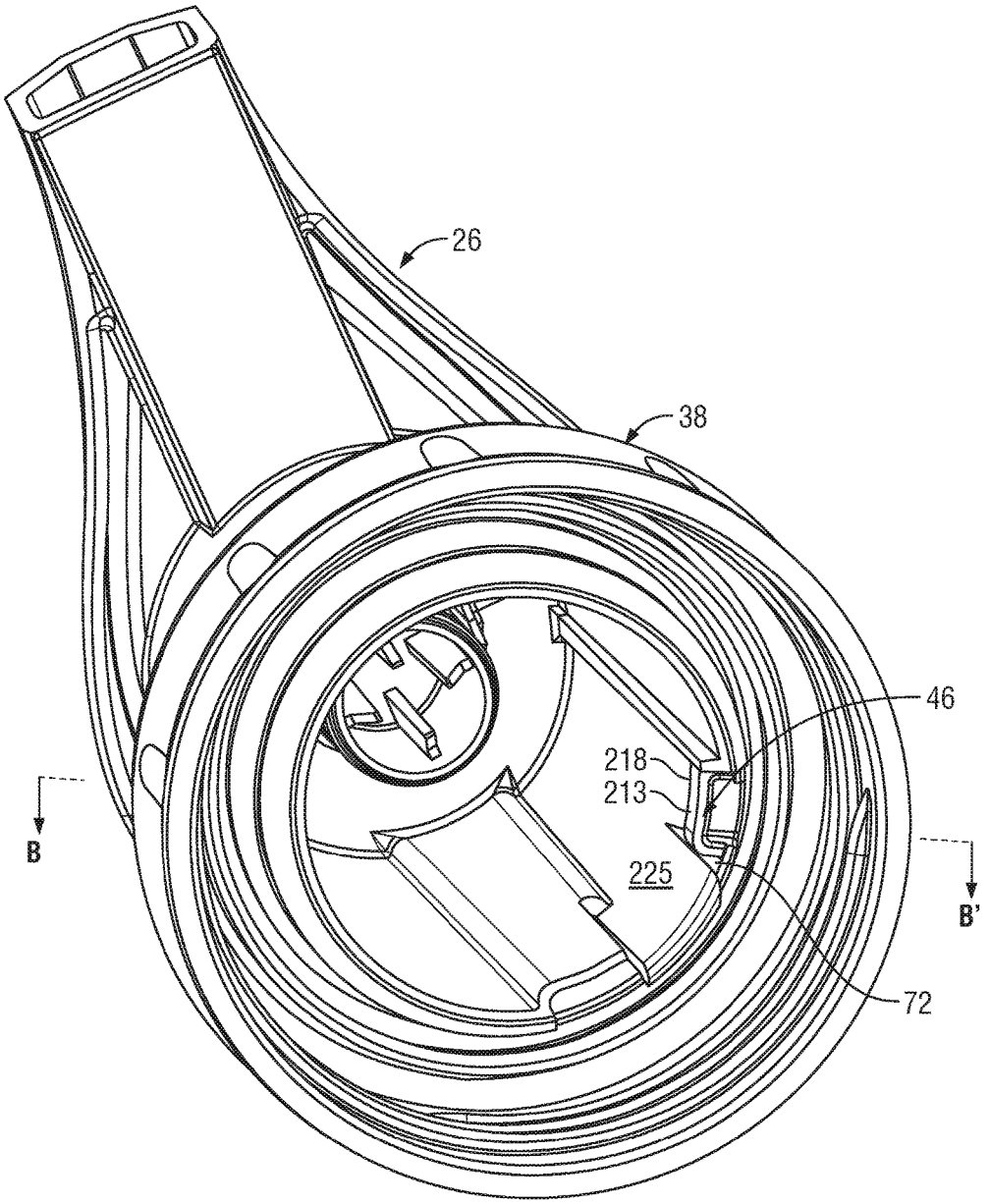
FIG. 16 is a pictorial bottom view showing merely the collar member coupled to the actuator member in the locked condition of FIG. 1.
Figure 17:
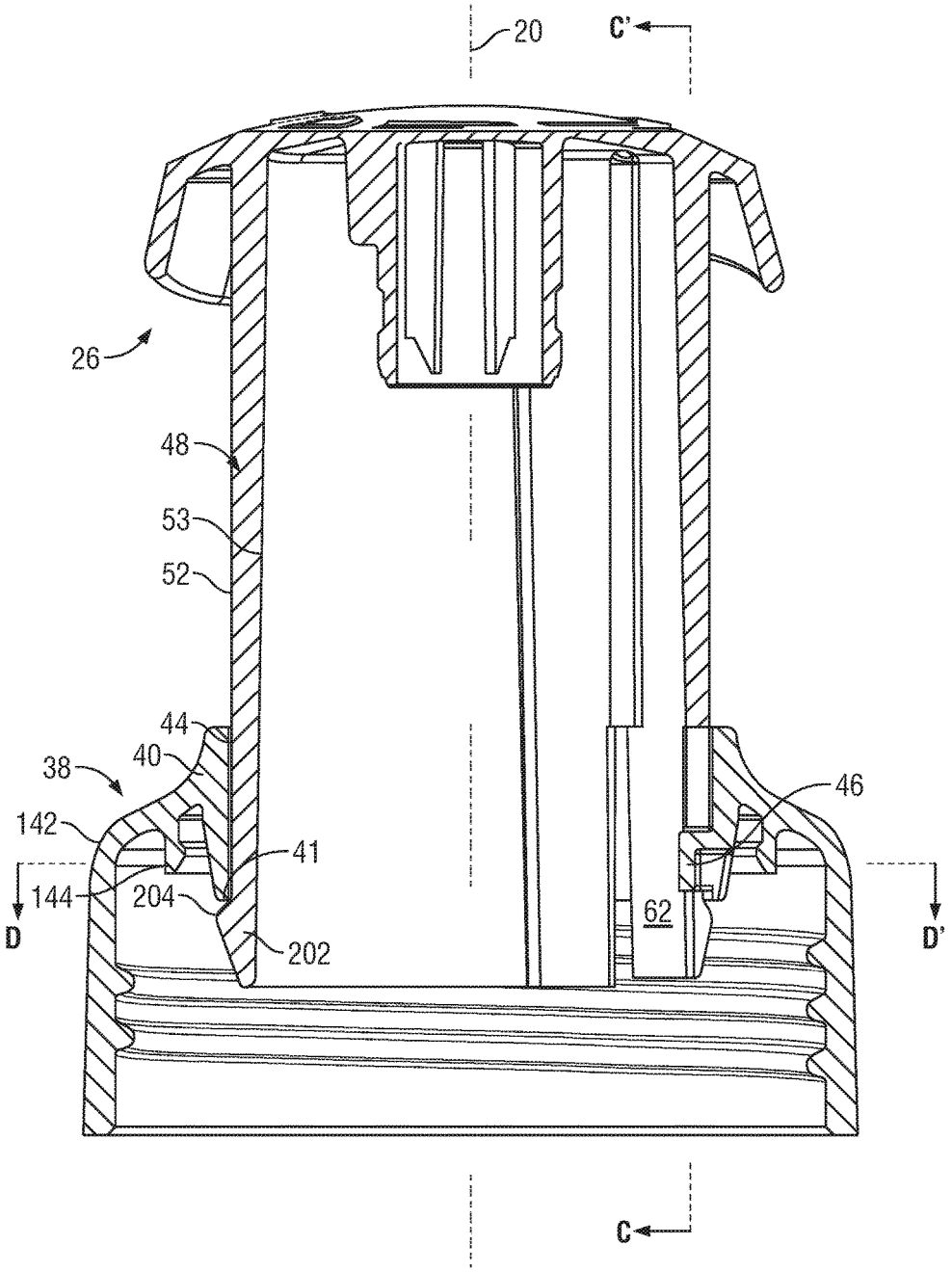
FIG. 17 is a cross-sectional side view through FIG. 16 along section plane B-B' in FIG. 16 including the central axis through the pump assembly.
Figure 18:
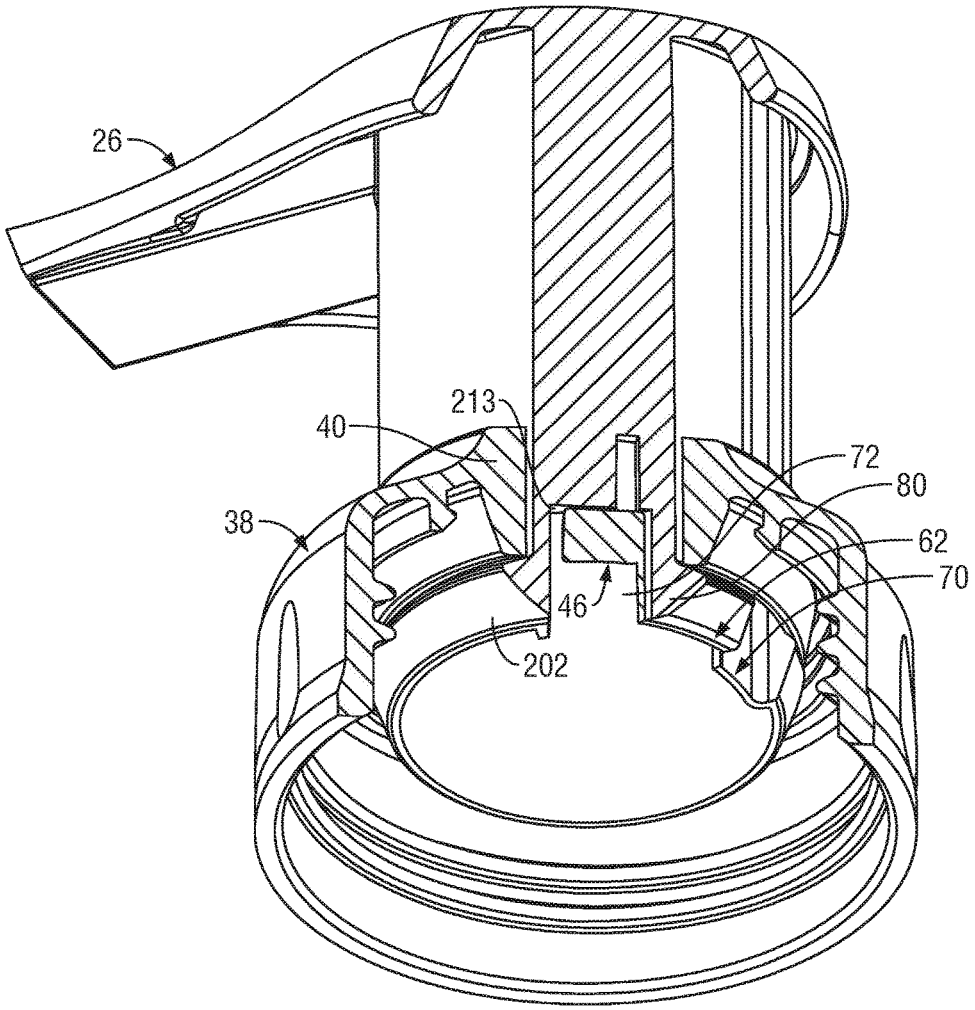
FIG. 18 is a pictorial cross-sectional view of the collar member and actuator member of FIG. 16 along section line C-C' in FIG. 17.

As can be best seen, for example, in FIGS. 17 and 18, the engagement of the stop shoulder 204 on the slide tube 48 with the axially inner end 41 of the inner guide tube 40 of the collar member 38 limits axial outward sliding of the actuator member 26 relative to the collar member 38 and, hence, as seen in FIGS. 4 and 5, limits the axial outward sliding of the piston-forming element 16 relative the piston chamber-forming body 14 in the extended position. As seen in the left-hand side of FIG. 17, the outer tubular side wall 52 of the slide tube 48 is in close relation to the radially inwardly directed inner guide surface 44 of the inner guide tube 40 on the collar member 38 so as to journal the actuator member 26 coaxially in the collar member 38 for both rotation about the axis 20 and coaxial sliding. If, hypothetically, the outer slide tube 48 and its radially outwardly directed outer tubular side wall 52 as well as the inner guide tube 40 and its radially inwardly directed inner guide surface 44 were 360° about their entire circumference to have the appearances seen in the left-hand side of FIG. 17, then the actuator member 26 would freely coaxially slide relative to the collar member 38 and the actuator member 26 would freely rotate relative to the collar member about the axis 20. This is not the case, however, as the lug member 46 carries on the collar member 38 and extending radially inwardly from the inner guide surface 44 of the collar member 38 interacts with various motion control features provided on the slide tube 48 of the actuator member 26. These motion control features on the slide tube 48 include, as seen in FIG. 15, an axially extending slide channel 70, a stop slot 72 and a finger member 62.

The axially extending slide channel 70 is provided on the slide tube 48 to extend radially inwardly from the outer tubular side tube wall 52 of the slide tube 48. The slide channel 70 is defined between two channel side walls 206 and 208 bridged by a channel base 210. The slide channel 70 is open radially outwardly over a circumferential extent C' between the slide walls 206 and 208. The channel base 210 has a radially outwardly directed base surface 211 and a radially inwardly directed base surface 212. The slide channel 70 has a radially extent R' measured from the base surface 211 to a radius about the axis 20 in which the outer tubular slide tube wall 52 lies. The slide channel 70 is open at an axially inner end 220 at the inner slide tube end 50. The slide channel is closed at an axially outer end wall 221. While the actuator member 26 is in an operative rotational position relative to the collar member 38, the lug member 46 is received within the slide channel 70, which condition arises in the unlocked conditions of FIGS. 2 and 3 in which the lug member 46 is axially slidable within the slide channel 70 permitting reciprocal axial movement of the actuator member 26 between the retracted position of FIG. 2 and the extended position of FIG. 3. The lug member 38 has its circumferential extent C and radial extent R complementary to the circumferential extent C' and radial extend R' of the side channel 70 so as to provide for relative axial sliding of the lug member 38 within the slide channel 70.

The stop slot 72 is provided on the slide tube 48 to extend radially inwardly from the outer slide tube wall 52 of the slide tube 48. The stop slot 72 as best seen in FIG. 15 is cut entirely through the slide tube 48. The stop slot 72 is bordered by a circumferentially and radially extending axially outer axial slot stop surface 213 and with the stop slot 72 extending circumferentially between a radially and axially extending left slot side surface 214 and an axially extending right slot side surface 216. The stop slot 72 extends circumferentially between the left slot side surface 214 and the right slot side surface 216 axially from the axial slot stop surface 213 axially inwardly to an axially inner slot opening 217 into the stop slot 72 at the inner side tube end 50. The stop slot 72 has a circumferential extent C" between the left slot side surface 214 and the right slot side surface 216 and an axial extent A" between the axial slot stop surface 213 and the inner slot opening 217. The slide stop 72 also has a radial extent R".

When the actuator member 26 and the collar member 38 are in an inoperative rotational position such as in FIGS. 1, 16, 17 and 18, the collar member 38 is coaxially about the actuator member 26 and the lug member 46 extends radially inwardly from the collar member 38 engaged within the stop slot 72 on the slide tube 48 of the actuator member 26. In this regard, the lug member 46 and the stop slot 72 are complementary sized as to their respective circumference extents C and C" and radially extents R and R" and axial extents A and A" respectively such that the lug member 46 is be received within the stop slot 72. With the lug member 46 received in the stop slot 72: (a) engagement between the axially outwardly directed outer axial lug stop surface 218 on the lug member 46 and the axial slot stop surface 213 of the stop slot 72 limits axial sliding of the lug member 46 within the stop slot 72 axially outwardly; (b) engagement between the right lug side surface 220 of the lug member 46 with the right slot side surface 216 of the stop slot 72 prevents relative rotation of the actuator member 26 and the collar member 36 in one direction about the axis 20; and (c) engagement of the left lug side surface 222 of the lug member 46 with the left slot side surface 214 of the stop slot 72 restricts relative rotation of the actuator member 26 and the collar member 38 about the axis 20 in an opposite direction.

In the inoperative rotational position with the lug member 46 of the collar member 38 received within the stop slot 72 of the actuator member 26, then a locked condition arises as illustrated in FIGS. 16, 17, 18 and 21.

Figure 13:
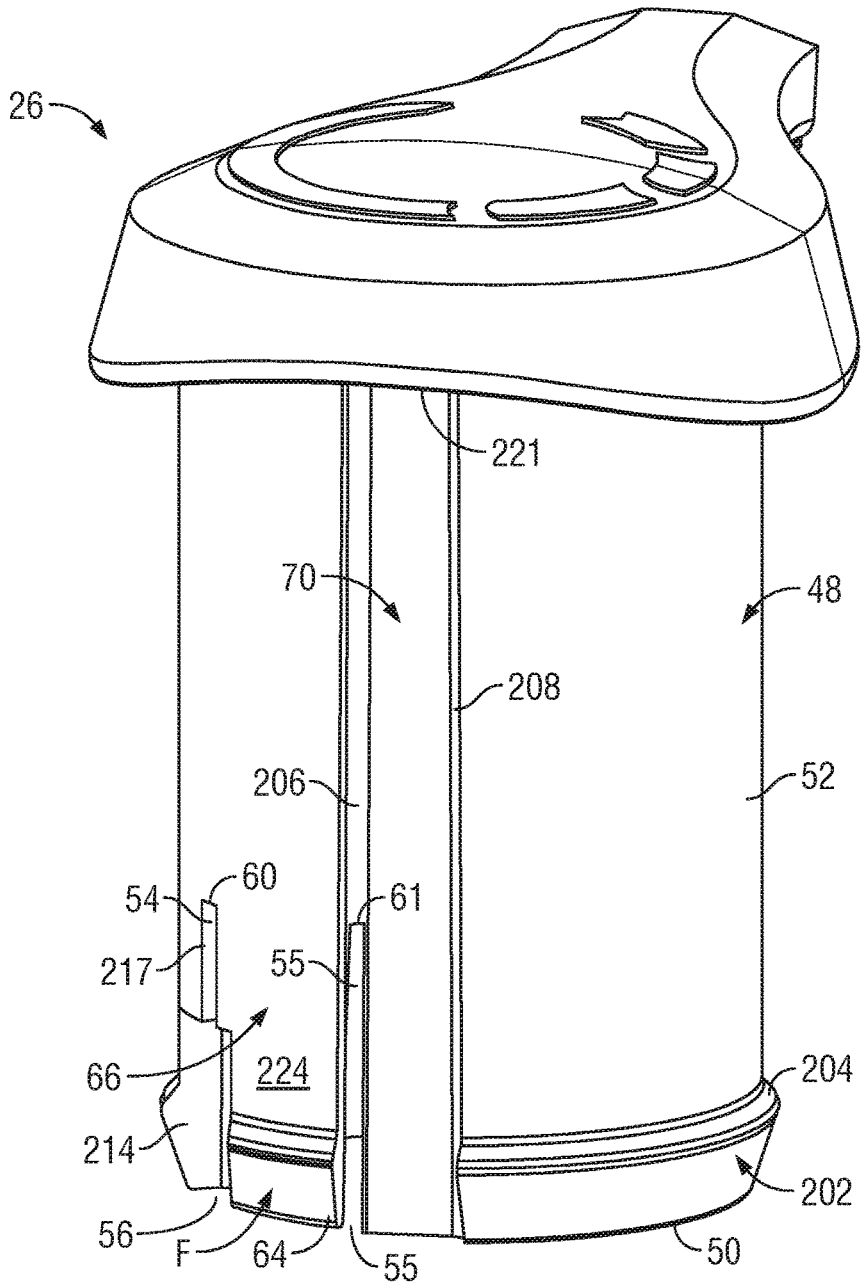
FIG. 13 is a pictorial rear view of the actuator member of FIG. 12 as seen from above.

The finger member 62 is provided on the slide tube 48 as a portion of the slide tube wall 52 between a pair of cut slots 54 and 55. Each of the cut slots 54 and 55 extends radially through the side wall tube 52 radially between the outer tubular slide tube wall 52 and the inner tubular slide tube wall 53. Each cut slot 54 and 55 extends axially from a respective axial inner slot end 56 and 57 open to the inner slide tube end 52 to a respective blind axial outer slot end 60 and 61 located spaced axially inwardly from the inner slide tube end 50. As best seen in FIG. 13, the cut slot 55 is provided as cut from the channel side wall 206 of the slide channel 70. The cut slot 54 is defined by the combination of the stop slot 72 and an axially outer slot portion 217 that extends axially outwardly from the stop slot 72. The finger member 62 is defined in the slide tube 40 circumferentially between the cut slots 54 and 55. The finger 62 extends from an axially inner distal end 64 of the finger member 62 to an axially outer end 66 of the finger member 62, where the finger member 62 merges into the slide tube wall 52 between the blind axial outer slot ends 60 and 61. As can be seen in FIG. 3, the blind axial outer slot ends 60 and 61 are spaced axially outwardly from the inner slide tube end 50 an equal distance. The finger member 62 has a radially outwardly directed outer surface 224 that is concave mirroring the curvature of the outer tubular side wall 52 and a radially inwardly directed inner surface 225 that is convex and mirroring the curvature of the inner tubular side wall 53. The finger member 62 has a left side surface 226 that includes the right slot side surface 216 and on the opposite side a right side surface 227.

Figure 14:
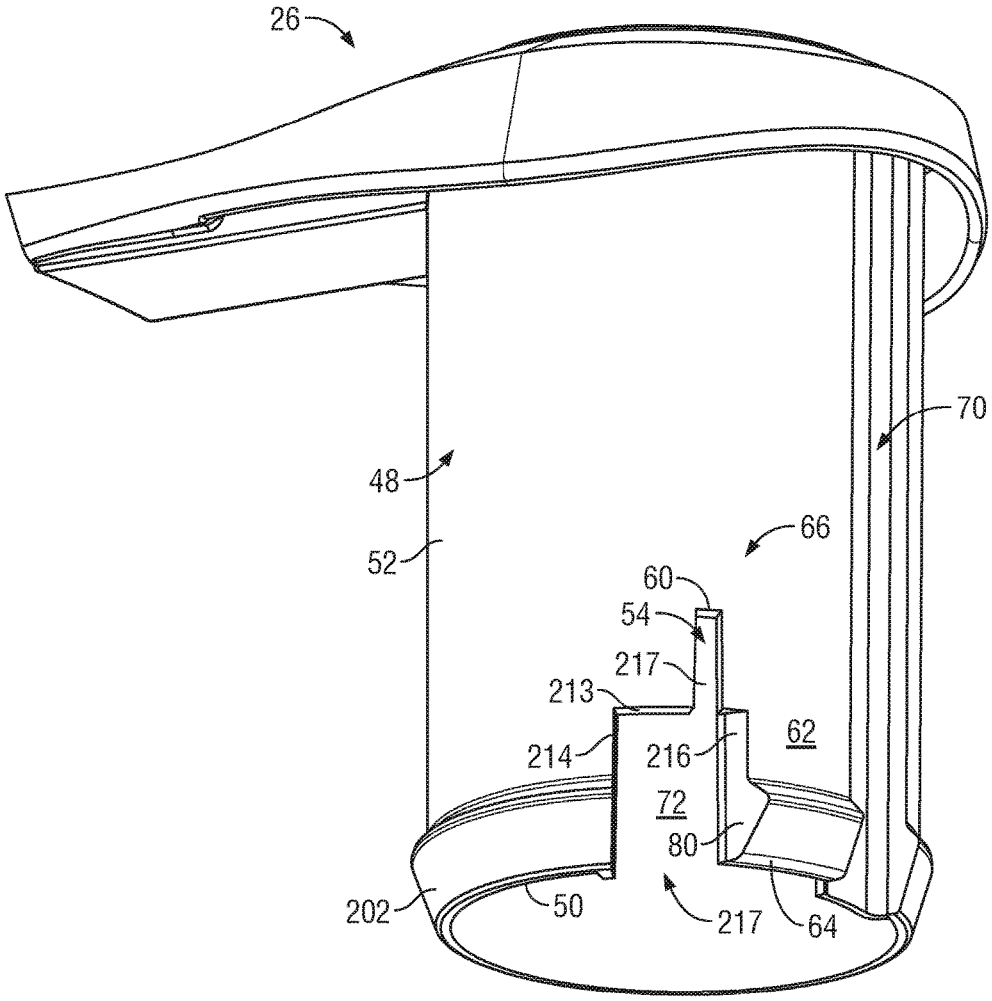
FIG. 14 is a pictorial right side view of the actuator member of FIG. 12 as seen from below.

The slide tube 48 is provided such that the finger member 62 is a resilient member that is deflectable by radially inward directed forces to move the distal end 64 the finger member 62 radially inwardly relative the slide tube wall 52. The finger member 62 is resilient and has an inherent bias to assume an unbiased condition as shown in FIGS. 13 to 15 conforming to the circular in cross-section shape of the slide tube 48. When a radially inwardly directed force is applied to the finger member 16 as schematically illustrated by the arrow F on FIG. 13, the finger member 62 deflects with movement of the distal end 64 of the finger member 62 radially inwardly relative the outer end 66 and, on release of such force F, the finger member 62 under its inherent bias moves towards its unbiased condition. The slide tube 48 is preferably made from materials having some inherent resiliency, preferably by injection molding as a unitary element from plastic materials. Suitable resiliency of the finger member 62 may be provided by the selection of the materials from which the slide tube 48 is made.

The right slot side surface 216 of the stop slot 72 comprises a portion of the left side surface 226 of the finger member 62 within the stop slot 72. The right slot side surface 216 includes a cammed surface 80 which, while extending axially, is "beveled" so as to extend at an acute angle to an axially and radially extending plane including the axis 20 with a distance of any point on the cammed surface 80 increasing in circumferential distance from the left slot side surface 214 with increased radius from the axis 20.

Each of FIGS. 16 to 19 are illustrations showing merely the actuator member 26 and the collar member 38 as coupled together and in which other components forming the pump assembly 10, not shown. Each of FIGS. 20 to 23 are illustrations showing merely the piston member 24, actuator member 26 and the collar member 38. Each of FIGS. 20 to 23 are cross-sectional views along section line D-D' in FIG. 17 in the extended position but with the piston member 24 and actuator member 28 as the piston-forming element 16 in different rotational positions about the axis 20 relative the collar member 38.

Figure 21:
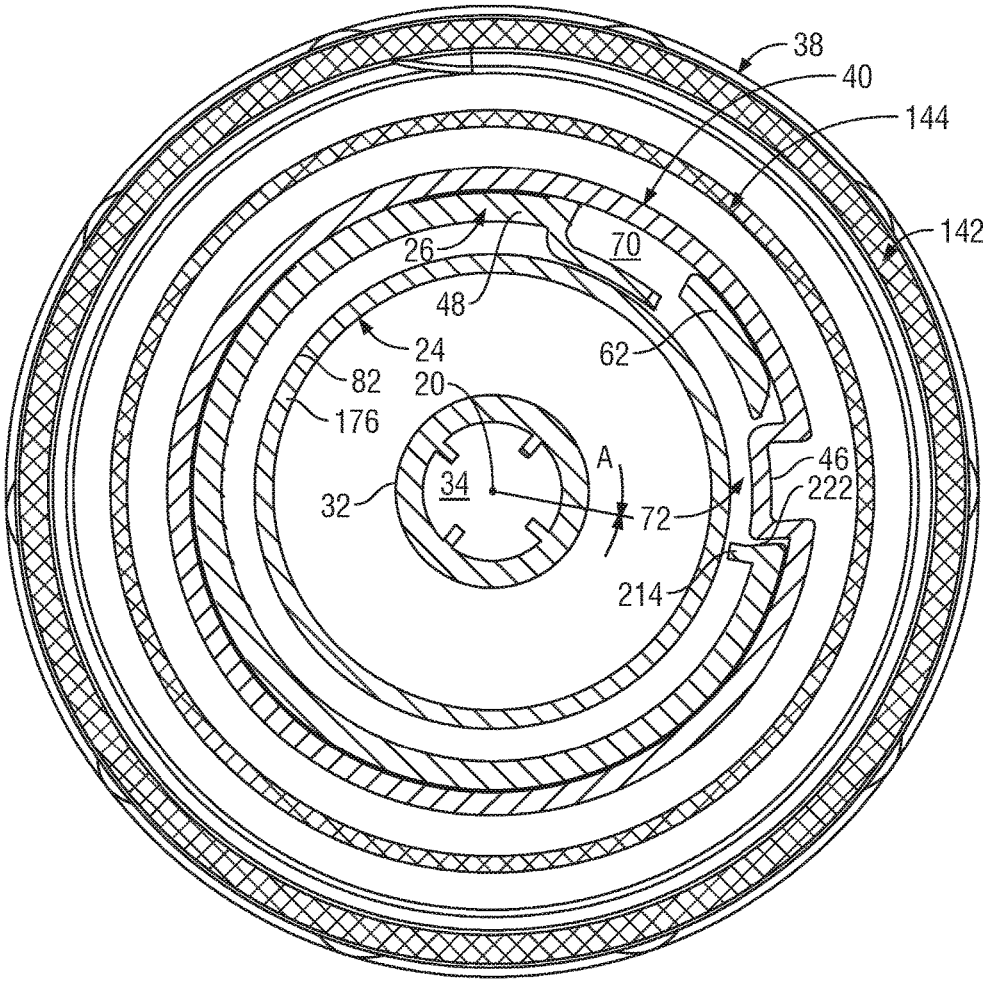
FIG. 21 is a view the same as FIG. 20 but with the pump in the locked extended position as in FIG. 1.
Figure 22:
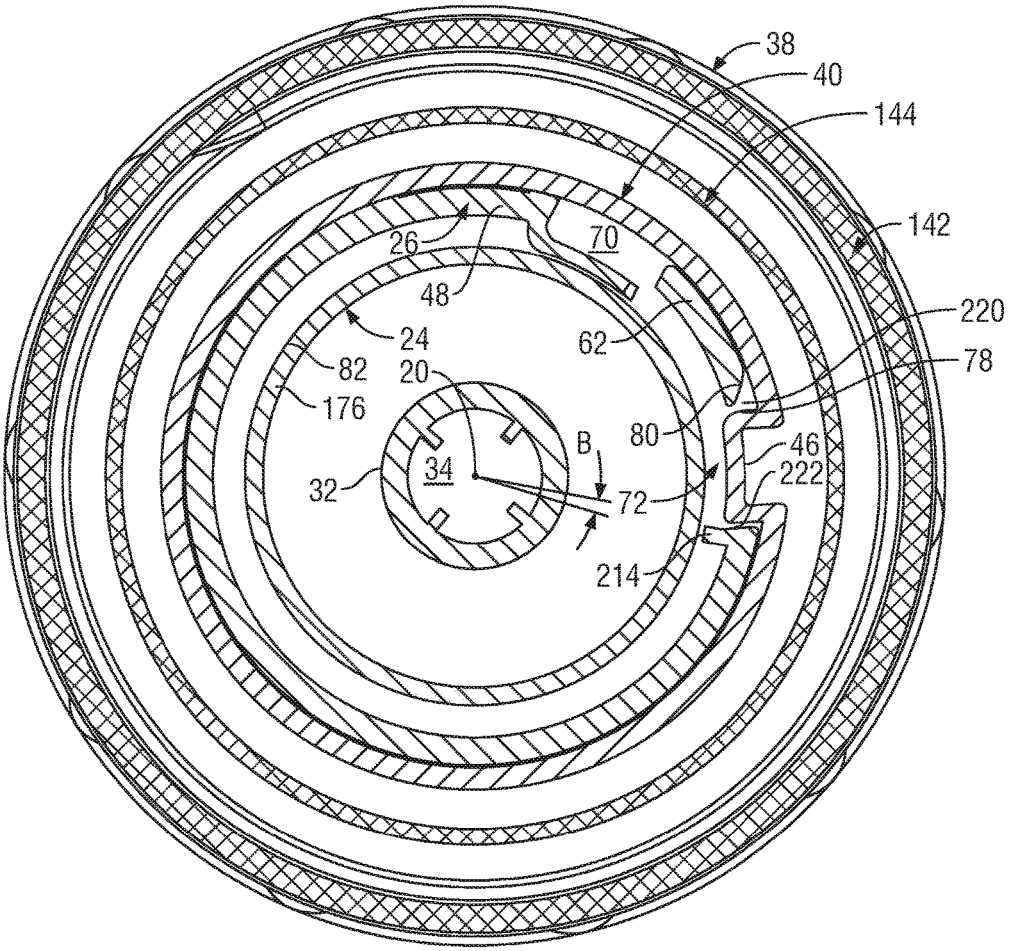
FIG. 22 is a view the same as FIG. 21 but in which the actuator member has been rotated clockwise relative to the collar member so as to increase an angular position indicated as A in FIG. 21 to an angular position indicated as B in FIG. 22.
Figure 23:
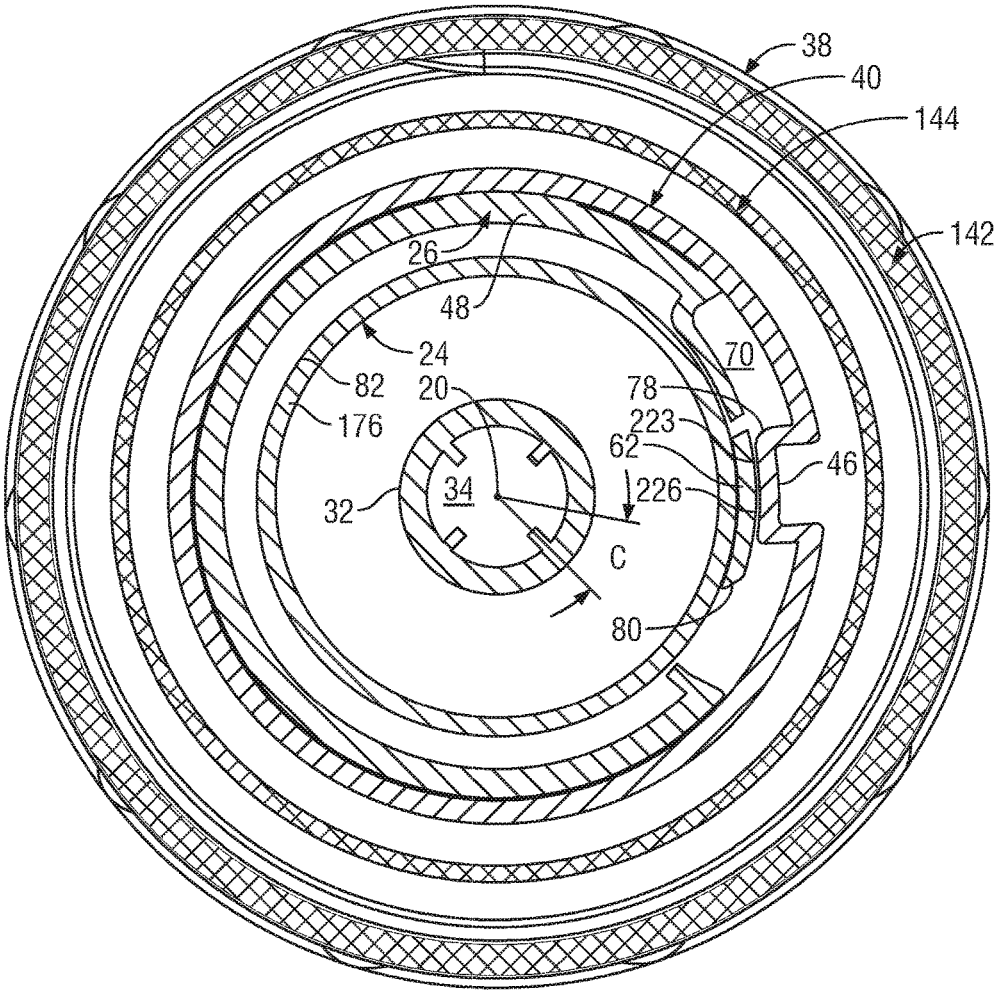
FIG. 23 is a view the same as FIG. 22 but in which the actuator member has been rotated clockwise relative to the collar member so as to increase an angular position indicated as B in FIG. 22 to an angular position indicated as C in FIG. 23.

Reference is made to FIGS. 16, 17, 18 and 21 which illustrate the actuator member 26 and the collar member 38 coupled together in the locked condition and the inoperative rotational position. In these Figures, under the bias of the spring member 15 (not shown) urging the actuator member 26 axially outwardly relative to the collar member 38, the outer axial lug stop surface 218 of the lug member 46 engages with the axial slot stop surface 213 of the stop slot 72 to limit coaxially outward sliding of the actuator member 26 relative to the collar member 38 thereby preventing operation of the liquid pump 30 and the air pump 31 to dispense the liquid and air. As best seen in FIG. 21, but also in FIG. 16, the left lug side surface 222 of the lug member 46 engages the left slot side surface 214 of the stop slot 72 to prevent rotation of the actuator member 26 clockwise relative to the collar member as seen in FIG. 21. On FIG. 21, an angular vector A is indicated as the angle of rotation about the axis 20 between the left lug side surface 222 and the left slot side surface 214 as effectively nil. In use, from the positions of FIGS. 16 and 21 the actuator member 26 is manually rotated counterclockwise relative to the collar member 38 until the right lug side surface 220 of the lug member 46 first engages the right slot side surface 216 with the camming surface 78 on the lug member 26 first engaging the cammed surface 80 of the finger member 62 and assume the positions of FIGS. 18 and 22 in which, as seen in FIG. 22, the angular vector B about the axis between the left lug side surface 222 and the left slot side surface 214 is marginally increased over angular vector A in FIG. 21. From the position illustrated in FIG. 22, on manual forces being applied to the actuator member 26 to rotate the actuator member 26 counterclockwise relative to the collar member 38, the camming surface 78 of the lug member 46 and the cammed surface 80 on the finger member 62 engage applying radially inwardly directed forces to the finger member 62 deflecting the finger member 62 radially inwardly out of the path of the lug member 46 and permitting lug member 46 to rotate circumferentially counterclockwise radially outwardly past the deflected finger member 62 as illustrated in FIG. 23 to have an angular vector C between the left lug side surface 222 and the left slot side surface 214 increased over the angular vector B in FIG. 22. As seen in FIG. 23, the radially inwardly directed circumferential lug surface 223 of the lug member 46 is engaged with the radially outwardly directed outer surface 226 of the finger member 62 to keep the finger member 62 deflected.

Figure 20:
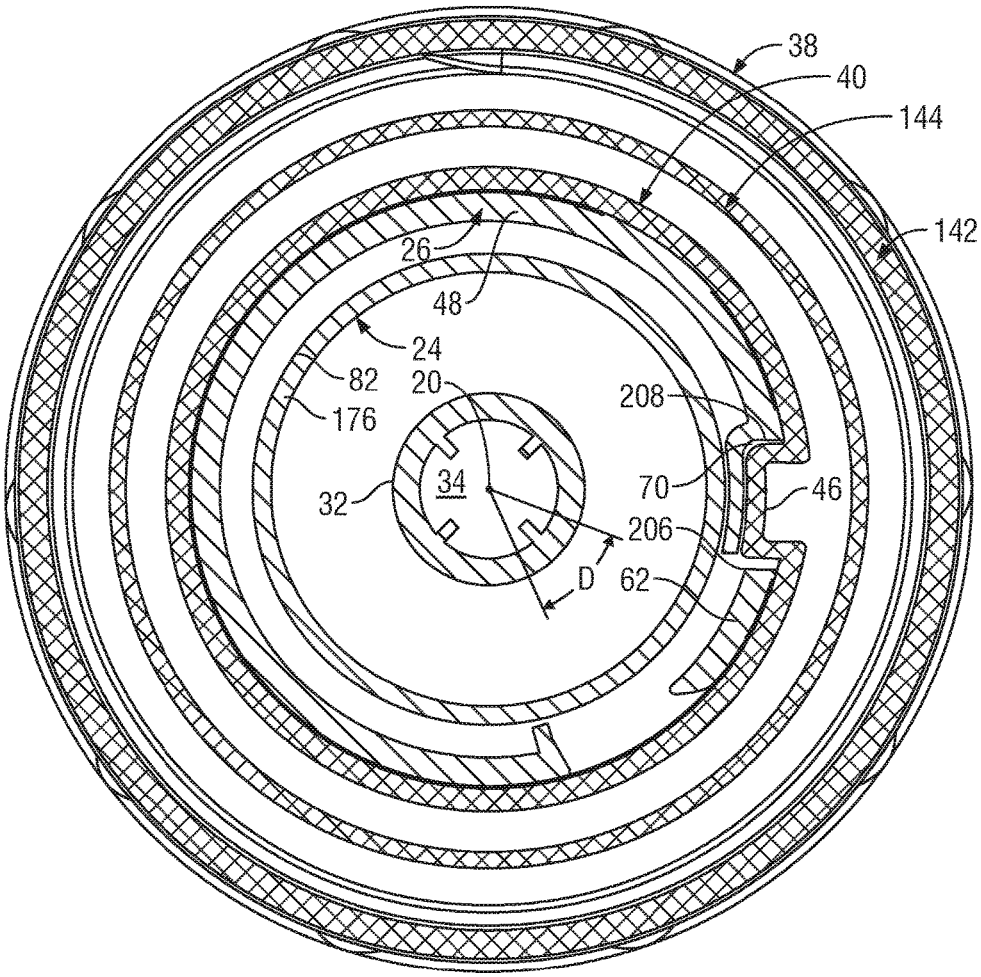
FIG. 20 is a cross-sectional top view along section line D-D' in FIG. 17 showing the pump in a unlocked extended position as in FIG. 2, however, with the chamber member and the spring member, not shown.

From the position illustrated in FIG. 23, with subsequent relative manual rotation of the actuator member 26 counterclockwise relative to the collar member 38, the lug member 46 comes to move circumferentially past the finger member 62 and become disposed within the slide channel 70 with counterclockwise movement of the actuator member 26 relative to the collar member 38 stopped with the left lug side surface 222 of the lug member 46 engaging the channel side wall 208 as seen in FIG. 20. As seen in FIG. 20, the angular vector D between the left lug side surface 222 and the left slot side surface 214 has increased over the angular vector C of FIG. 23. As seen in FIG. 20, the lug member 46 has moved counterclockwise past the finger member 62 and the finger member 62 under its inherent bias has moved radially outwardly from the defected condition shown in FIG. 23 towards the unbiased condition as shown in FIG. 20. In FIG. 20, the lug member 26 is constrained within the side channel 70 by being disposed circumferentially between the channel side walls 206 and 208 with the side surfaces of the finger member 62 in opposed relation to the channel slide walls 206 and 208. The lug member 46 once received within the slide channel 70 is maintained within the slide channel 70 preventing relative rotation of the actuator member 26 relative to the collar member 38 by reason of the lug member 46 being constrained between the channel side walls 206 and 208. The engagement of the channel side wall 206 including the left side surface 226 of the finger member 62 prevents movement of the lug member 46 from the slide channel 70 with clockwise rotation of the actuator member 26 relative the collar member 38. The unlocked condition and operative rotational position illustrated in FIG. 20 corresponds to the unlocked extended position shown in FIG. 2 from which the actuator member 26 is free to slide coaxially relative to the collar member 38 between the extended position of FIG. 5 and the retracted position of FIG. 6 for operation of the liquid pump 30 and the air pump 31.

Figure 19:
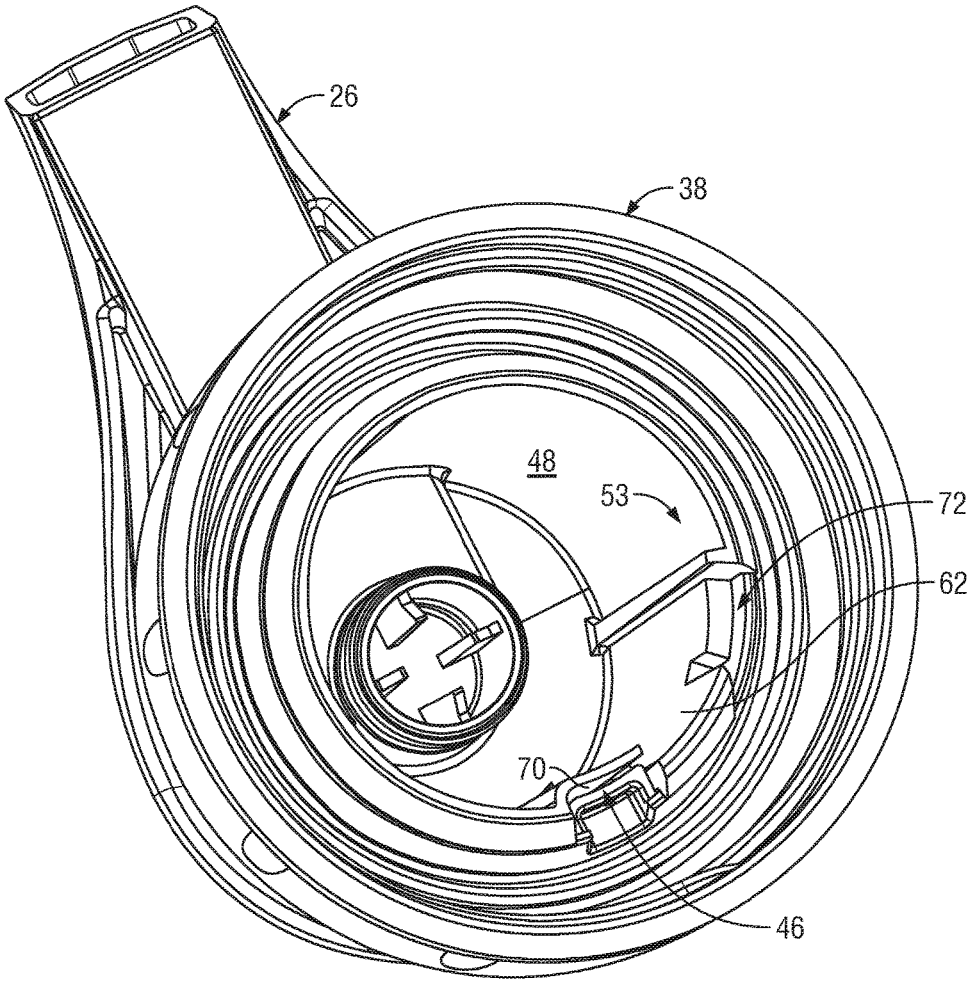
FIG. 19 is a pictorial bottom view similar to FIG. 16, but showing the collar member and the actuator member in the unlocked retracted condition of FIG. 2.

FIG. 19 illustrates the unlocked condition as shown in FIG. 20 with the lug member 26 received within the side channel 70 in the extended position of FIGS. 2 and 5.

As one manner of assembling the pump 10, the actuator member 26 and the collar member 38 may be coupled together with the lug member 46 received with the stop slot 72. Subsequently, the piston member 24 may be coupled to the actuator member 26 and then the tube member 39 maybe coaxially disposed about the piston member 24 and coupled to the collar member 38. Of course, the various other components such as the one-way valve 17, the foam generator 25 and the spring member 95 are to be inserted at appropriate times in these assembly steps. Such an assembled pump 10 would thus have as an initial condition as in FIG. 1, that is, in a locked condition in the inoperative rotational position and the extended position with engagement of the lug member 46 in the stop slot 72 preventing axial sliding of the actuator member 26 to the retracted position, preventing rotation of the actuator member 26 clockwise and resisting rotation of the actuator member 26 counterclockwise relative to the collar member 38 unless sufficient relative rotational forces are applied to the actuator member 26 that engagement between the lug member 46 and the finger member 62 deflects the finger member 62 radially inwardly to permit the lug member 46 to rotate counterclockwise to be received within the slide channel 70 assuming the unlocked condition in the operative rotational position and extended position of FIG. 2. In the unlocked condition and extended position of FIG. 2, the actuator member 26 is free to move between the unlocked extended position of FIG. 2 and the unlocked retracted position of FIG. 3 to dispense the fluid and air. In the preferred embodiment of FIGS. 1 to 23, once the lug member 46 becomes engaged within the slide channel 70 the lug member 46 cannot be moved out of the slide channel 70.

In accordance with the preferred embodiment, the rotational forces required to be applied by a user in rotating the actuator member 26 such that engagement between the lug member 46 and the finger member 62 will deflect the finger member 62 sufficiently that the lug member 46 will move radially past the finger member 62 are preferably selected such that there is a clear tactical indication given to the user firstly that the actuator member 26 is in the inoperative rotational position relative to the collar member 38 and, secondly, that the finger member 62 has become received within the slide channel 70 and is in the operational rotational position.

Referring to FIG. 11, the tubular portion 176 of the air disc 157 carries a radially outwardly directed finger stopping surface 82. As best seen in FIGS. 20 to 23, the tubular portion 176 is located radially inwardly from the finger member 62 with the radially outwardly directed finger stopping surface 82 opposed to the radially inwardly directed inner surface 225 of the finger member 62 and, as seen in FIG. 23, limits radial inward deflection of the finger member 62. As seen in FIG. 23, on radial inward deflection of the finger member 62, the finger stopping surface 82 located radially inwardly from the finger member 62 is engaged by the finger member 62 and increases the resistance to deflecting the finger member 62 radially inwardly out of the path of the lug member 46, as can be advantageous to serve a number of purposes.

Preferably, the actuator member 26 and its slide tube 48 including the finger member 62 are integrally formed by injection molding from a material having desired properties with an inherent resiliency so as to provide the finger member 62 to assume an inherent unbiased position, permit deflection of the finger member 62 and return of the finger member 62 to the inherent unbiased position. Providing the finger stopping surface 82 located radially inwardly from the finger member 62 can assist in controlling deflection of the finger member 62. For example, in deflection of the finger member 62 the axially inner distal end 64 of the finger member 62 will come to engage the finger stopping surface 82 and limit further inward deflection of the distal end 64. This can be advantageous to prevent undue deflection and deformation of the finger member 62 as at its outer end 66. In one first arrangement, the tubular portion 176 may be relatively rigid to prevent radial inward movement of the finger member 62 when engaged by the finger 62. In this first arrangement, once the inner distal end 64 of the finger member 62 engages the finger stopping surface 82, increased radially inward deflection of the finger member 62 between its distal end 64 and its outer end 66 may be required to permit the lug member 46 to move circumferentially therepast thereby increasing the resistance required to deflect the finger member 62 outwardly out of the path of the lug member 46.

In a second arrangement, the finger stopping surface 82 is resilient having an inherent bias to assume an inherent position and when deflected from the inherent position to return to the inherent position. In this regard, the tubular portion 176 may provide for such resiliency and insofar as the finger member 62 is moved radially inwardly, such radial inwardly movement of the finger member 62 will deflect the finger stopping surface 82 radially inwardly with the finger stopping surface 82 resiliently biasing the finger member 62 radially outwardly towards the inherent biased position of the tubular portion 176. The tubular portion 176 may preferably be formed of a material that provides resiliency and is biased to return to an inherent position and will urge finger member 62 radially outwardly.

In the preferred embodiments as illustrated, for example, in FIG. 23, the inherent resiliency of the tubular portion 176 provides at least stopping and preferably a resiliency. Alternatively, a separate annular spring member (not shown) could be provided and carried with the tubular portion 176 to provide in effect a spring to bias the finger member 62 radially outwardly.

Referring to FIG. 21, the finger member 62 in its unbiased condition as shown in FIG. 21 is spaced radially from the finger stopping surface 82, that is, with the radially inwardly directed inner surface 225 of the finger member 62 spaced from the finger stopping surface 82. As an alternate arrangement, the finger member 62 as seen in the unbiased condition as shown in FIG. 21 could have its radial thickness increased so as to provide the radially inwardly directed inner surface 225 of the finger member 62 closely adjacent the finger stopping surface 82 even when the finger member 62 is in its inherent unbiased position as seen in FIG. 21. In this arrangement, for inward movement of the finger member 62, there would be the requirement of radial inward deflection of the tubular portion 176 which would need to have an acceptable resiliency and with the advantage that the resiliency of the tubular portion 176 would serve to return the finger member 62 to its unbiased configuration. With such an arrangement the extent to which the finger member 62 needs merely be deflectable and the need to be resilient is reduced or at least substantially eliminated.

Maintaining a resilient resistance to deflection of the finger member 62 inwardly and biasing the finger member 62 to move to its inherent position radially outwardly can be advantageous to ensure that a user on rotating the actuator member 26 relative to the collar member 38 receives tactical sensory feedback, that is, feedback perceptible by touch, indicative of the change in rotational positions as can be useful for a user to understand the relative position of the actuator member 26 and the collar 38.

Figure 24:
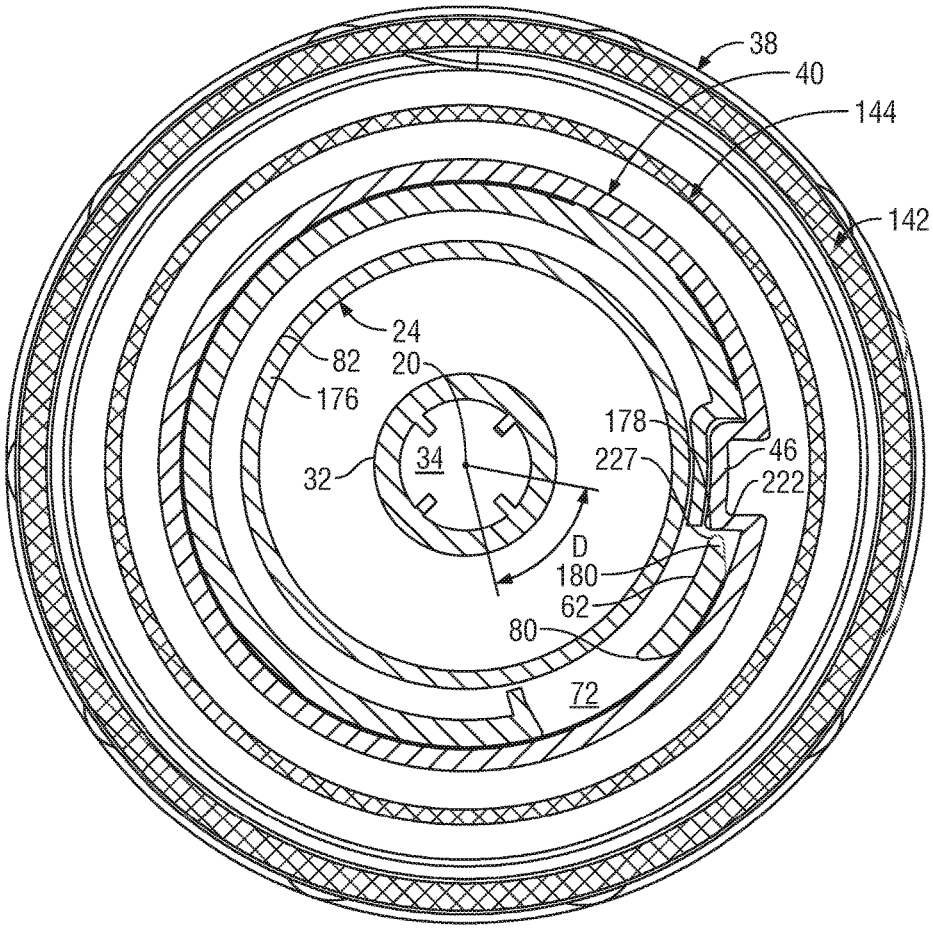
FIG. 24 is a view the same as FIG. 20 but showing a second embodiment of a pump assembly in accordance with the present invention.

In accordance with the first embodiment of the present invention as illustrated in FIG. 22, the camming surface 78 on the lug member 46 engages with the cammed surface 80 on the finger member 62 to deflect the finger member 62 radially inwardly so as to permit rotation of the actuator member 26 counterclockwise relative to the lug member 46, however, clockwise rotation of the actuator member 26 relative to the collar member 38 is prevented. Reference is made to FIG. 24 which shows a second embodiment of a pump in accordance with the present invention. FIG. 24 is identical to FIG. 20 but for two exceptions. As a first exception, the lug member 46 is modified to include as a curved merger of the left lug side surface 222 and the circumferential lug surface 223 a camming surface 178 and, as a second exception, the finger member 62 includes on its right side surface 227 a cammed surface 180. On rotation of the actuator member 26 clockwise relative to the collar member 38, the engagement of the camming surface 178 and the cammed surface 180 deflects the finger member 62 radially inwardly out of the path of the lug member 46 permitting the lug member 46 to rotate circumferentially clockwise past the finger member 62 from the operative rotational position shown in FIG. 20, through to positions similar to that shown on FIGS. 23 and 22, to an inoperative rotational position similar to that shown on FIG. 21. In FIG. 24, relative clockwise rotation of the actuator member 26 relative to the collar member 68 from the operative rotational position towards the inoperative rotational positional is blocked by the lug member 36 engaging the finger member 62, however, insofar as sufficient clockwise rotational forces are applied to the actuator member 26, then the engagement between the camming surface 178 of the lug member 46 and the cammed surface 180 of the finger member 62 will deflect the finger member 62 so as to permit relative clockwise rotation of the lug member 46 from within the slide channel 70 to within the stop slot 72.

Figure 25:
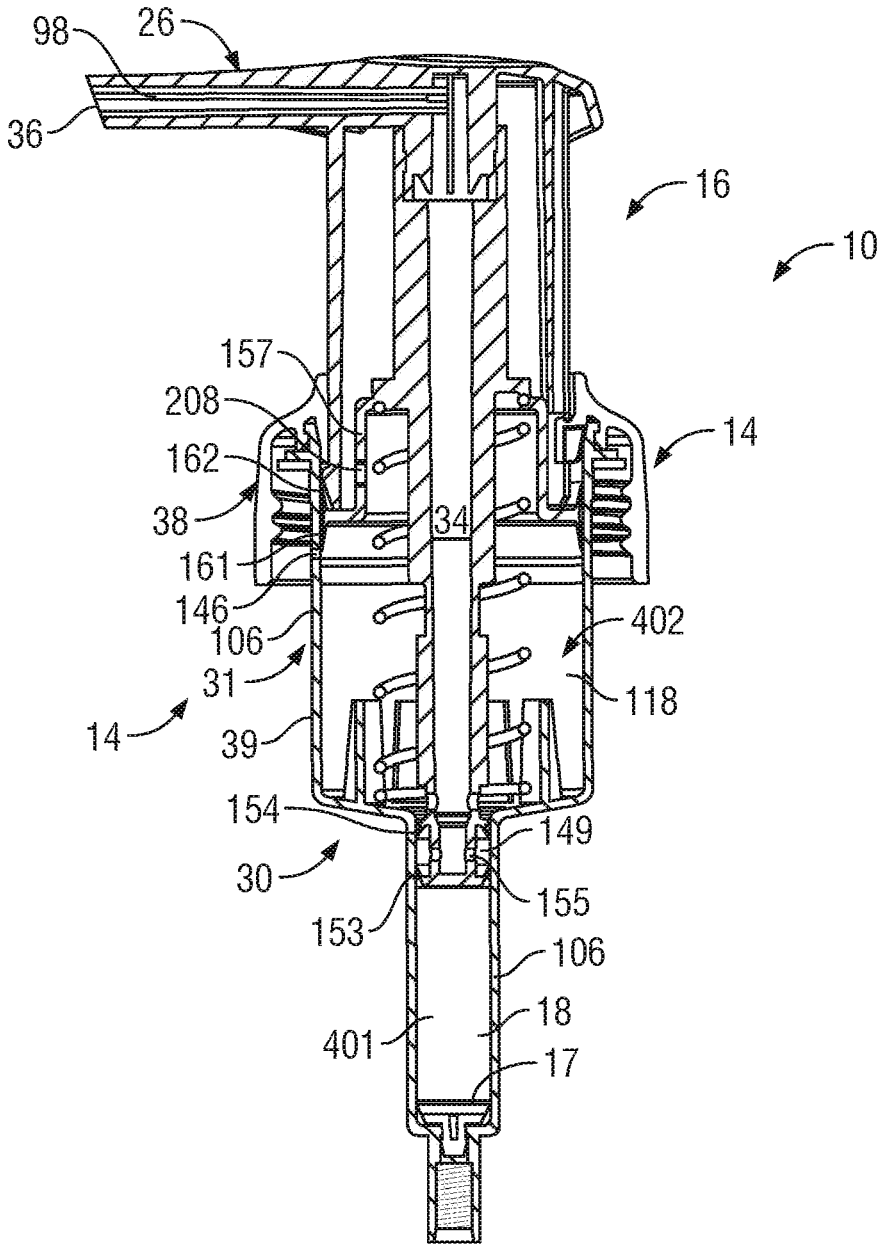
FIG. 25 is a cross-sectional side view the same as FIG. 5, but showing a pump assembly in accordance with a third embodiment of the present invention.

Reference is made to FIG. 25 which illustrates a cross-sectional side view substantially the same as FIG. 5, but showing a pump assembly 10 in accordance with a third embodiment of the present invention. FIG. 25 is identical to FIG. 5 but for three exceptions. As a first exception, the transfer ports 156 through the stem 32 have been eliminated. As a second exception, an air transfer opening 208 has been provided radially through the tubular portion 176 of the air disc 157. As a third exception, the passageway 34 through the stem 32 has been reduced to have a simplified, reduced and more constant diameter, and the foam generator 25 is eliminated.

As contrasted with the pump assembly 10 of the first embodiment which included both a liquid pump 30 and an air pump 31, the pump assembly 10 in accordance with the third embodiment of FIG. 25 merely includes the liquid pump 30 and does not include an air pump. Air within the air compartment 402 is free to move through the air transfer opening 208 and, hence, to the atmosphere. No communication is provided from the air compartment 402 into the passageway 34. The operation of the pump assembly 10 in FIG. 25 and the opening and closing of the air port 146 by the air disc 157 is unchanged and continues to provide selective passage of atmospheric air into the container 12. While the third embodiment of FIG. 25 continues to show the tube member 39 has having a stepped configuration, insofar as merely a liquid pump 30 is provided, the pump assembly of FIG. 25 could be modified so that the diameter of the air chamber 118 is the same as or closer to the diameter of the liquid chamber 19.

Figure 26:
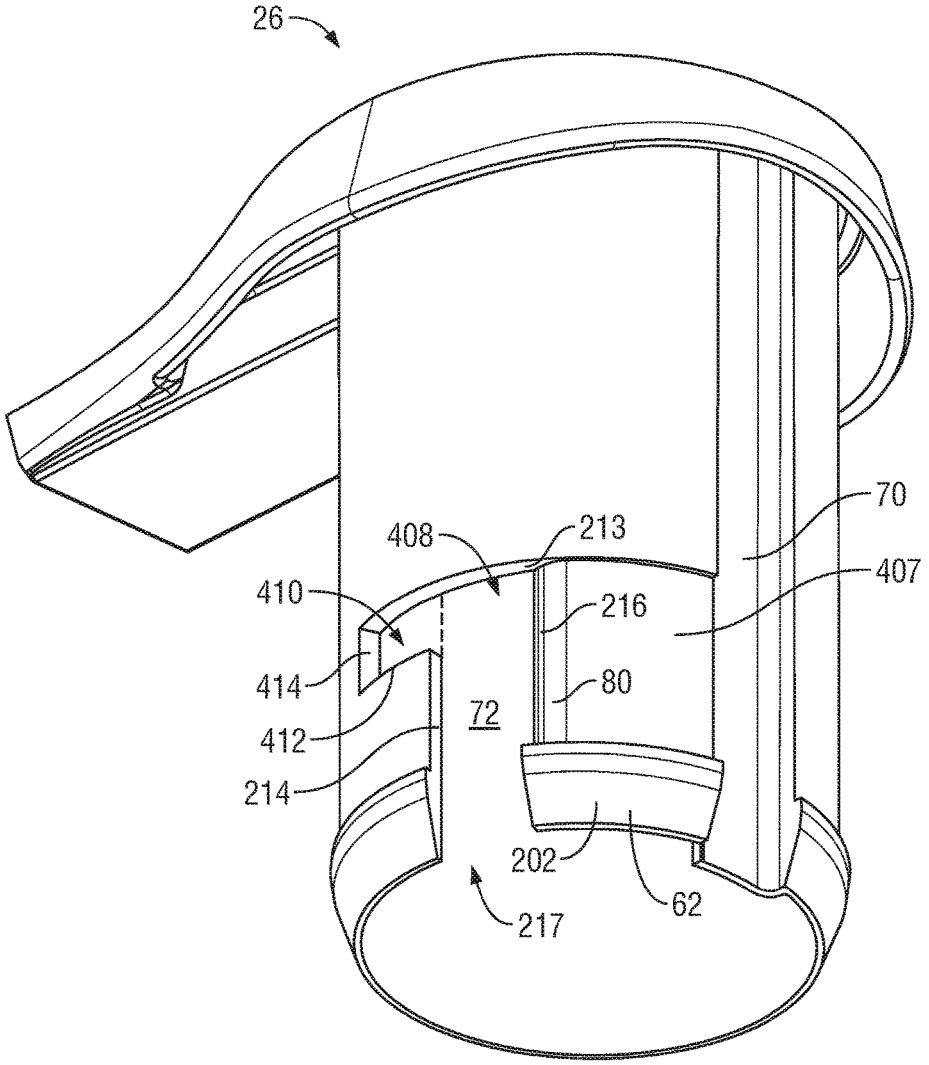
FIG. 26 is a pictorial right side view of an actuator member as seen from below for a fourth embodiment of a pump assembly in accordance with the present invention.

Reference is made to FIG. 26 showing a perspective view of an actuator member for a fourth embodiment of a pump assembly in accordance with the present invention. The actuator member of FIG. 26 has close similarities to the actuator member 26 described with reference to that of the first embodiment as notably shown in FIG. 14. In the actuator member 26 of FIG. 26, the stop slot 72 has been modified compared to the stop slot 72 in FIG. 14. On FIG. 26, dashed lines 406 delineate an axial portion 408 of the stop slot 72 from a circumferential portion 210 of the stop slot 72. The axial portion 408 guides and permits sliding of the lug member 46 axially outwardly relative to the actuator member 26 from the inner end opening 217 until the lug member 46 engages the outer stop surface 213. The circumferential portion 410 opens circumferentially into the axial portion 408 in a direction extends circumferentially away from the axial portion 408 and away from the finger member 62. The circumferential portion 410 is defined axially between the axial outer stop surface 213 and an outwardly directed axially inner stop shoulder 412. The circumferential portion 210 ends circumferentially at an axially and radially extending rotation stop surface 414 bridging between the outer stop surface 213 and the inner stop shoulder 412. While the lug member 26 is in the axial portion 410 engaged with the outer stop surface 213 against the bias of the spring 15, rotation of the actuator member 26 clockwise relative to the collar member 38 moves the lug member 46 circumferentially into the circumferential portion 410. While lug member 46 is received in the circumferential portion 410 between the outer stop surface 213 and the inner stop shoulder 412, coaxial sliding of the actuator member 26 relative to the collar member 38 is prevented both axially outward and axially inwardly. Axially inwardly from the inner stop shoulder 412, the axial portion 408 is bordered by the right slot side surface 216. When the lug member 46 is in the axial portion 408 under merely the influence of the spring 15, the spring 15 biases the actuator member 26 axially outwardly relative the collar member 38 to the extended position in which extended position the lug member 46 is in a location axially inwardly from the circumferential portion 410 and with clockwise rotation of the lug member 46 prevented by engagement with the left slot side surface 214. To move the lug member 46 from the extended position axially within the axial portion 408 to enter the circumferential portion 210, it is necessary to apply manual forces to the actuator member 26 to compress the spring member 15 from the extended position towards the retracted position until the lug member 46 engages the outer stop surface 213 at which point manual rotation of the actuator member 26 clockwise relative to the collar member 38 moves that the lug member 46 into the circumferential portion 410 of the stop slot 72.

On FIG. 26, the cammed surface 80 on the finger member 62 is shown to extend from the end flange 202 to the outer stop surface 213. This is preferred such that with the lug member 46 in the circumferential portion 410 rotation counterclockwise with sufficient force will result in the lug member 46 engaging and deflecting the finger member 62 radially inwardly. However, in another configuration, the cammed surface 80 may merely extend from the end flange 202 to just axially outwardly beyond the position the lug member 46 assumes in the extended position, in which case, the lug member 46 would need to move axially inwardly in the axial portion 408 before further rotation counterclockwise will engage the cammed surface 80 to deflect the finger member 62. On FIG. 26, the finger member 62 has a reduced radial thickness circumferentially adjacent the cammed surface 80 over a circumferentially extending slotway 107 provided between the end flange 202 and a circumferential extension of the end flange 202. On FIG. 26, unlike FIG. 5, the cammed surface 80 is not provided on the end flange 202.

Figure 28:
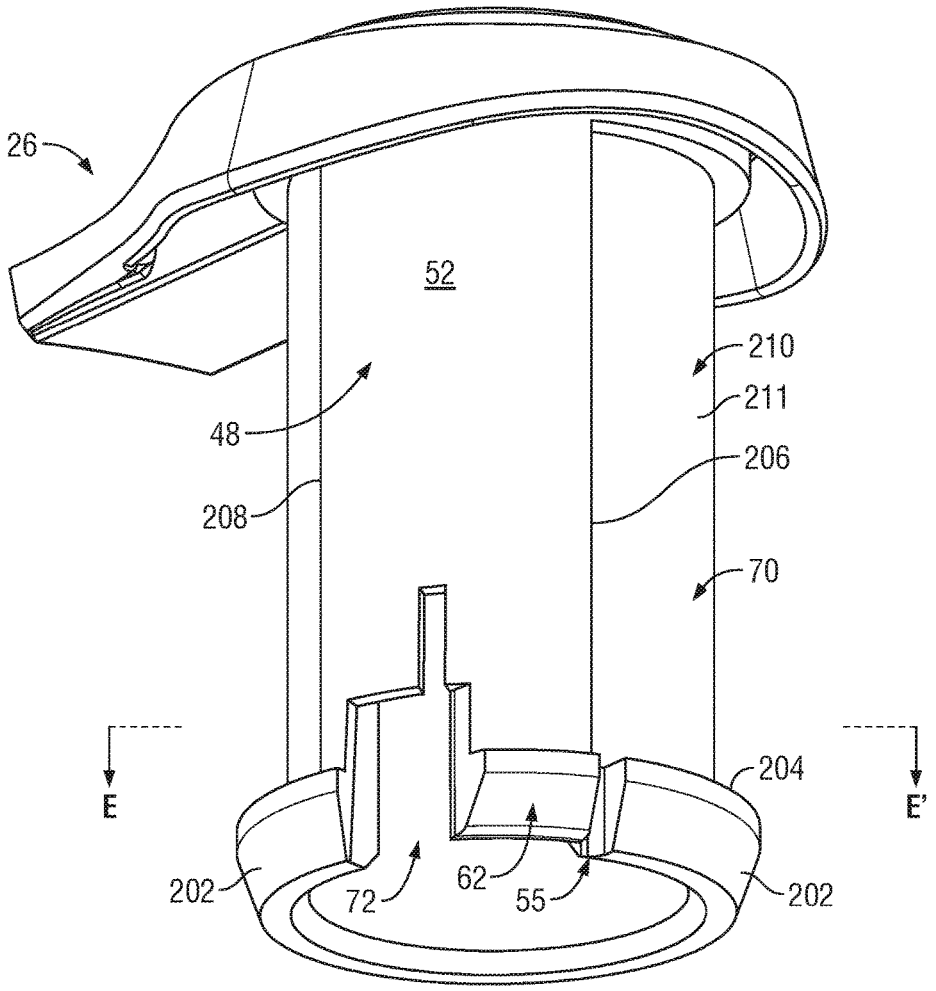
FIG. 28 is a pictorial right side view of the actuator member as seen from below for the fifth embodiment of the pump assembly and dispenser shown in FIG. 27.
Figure 29:
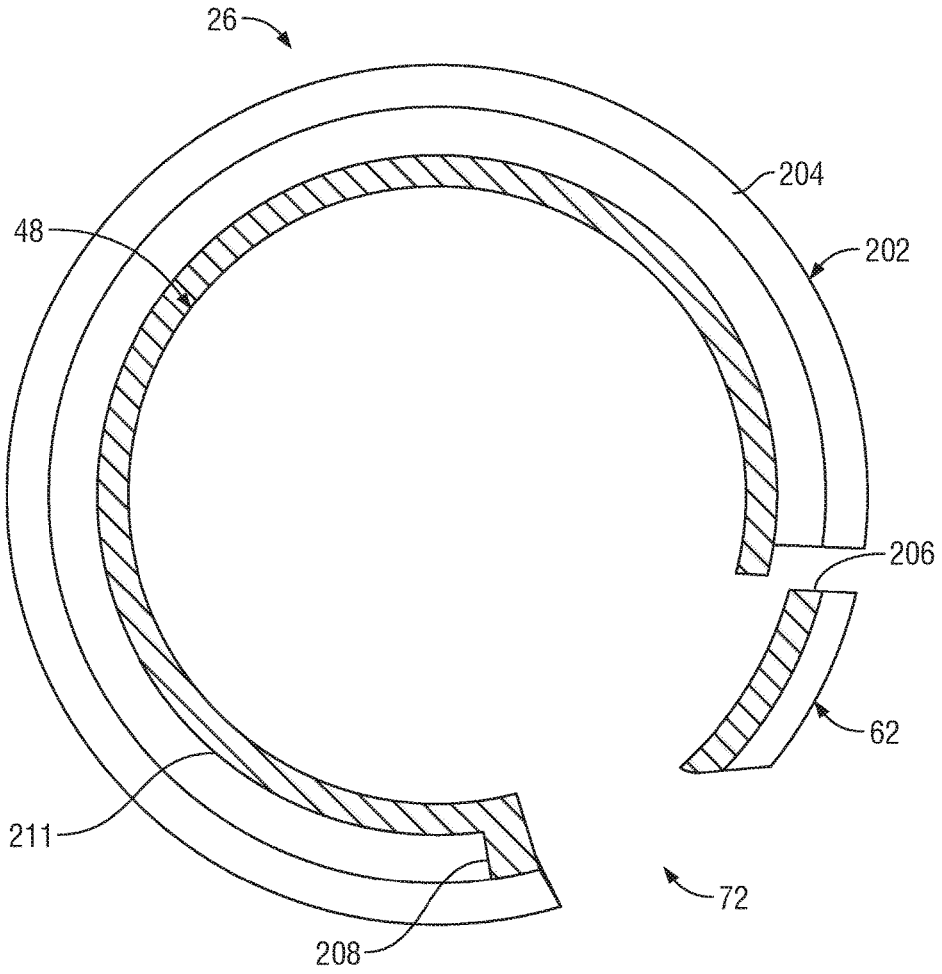
FIG. 29 is cross-sectional side view through FIG. 28 along section plane E-E'.

Reference is made to FIGS. 28 and 29 which illustrate a fifth embodiment of a dispenser 9 and a pump 10 in accordance with the present invention.

Figure 27:
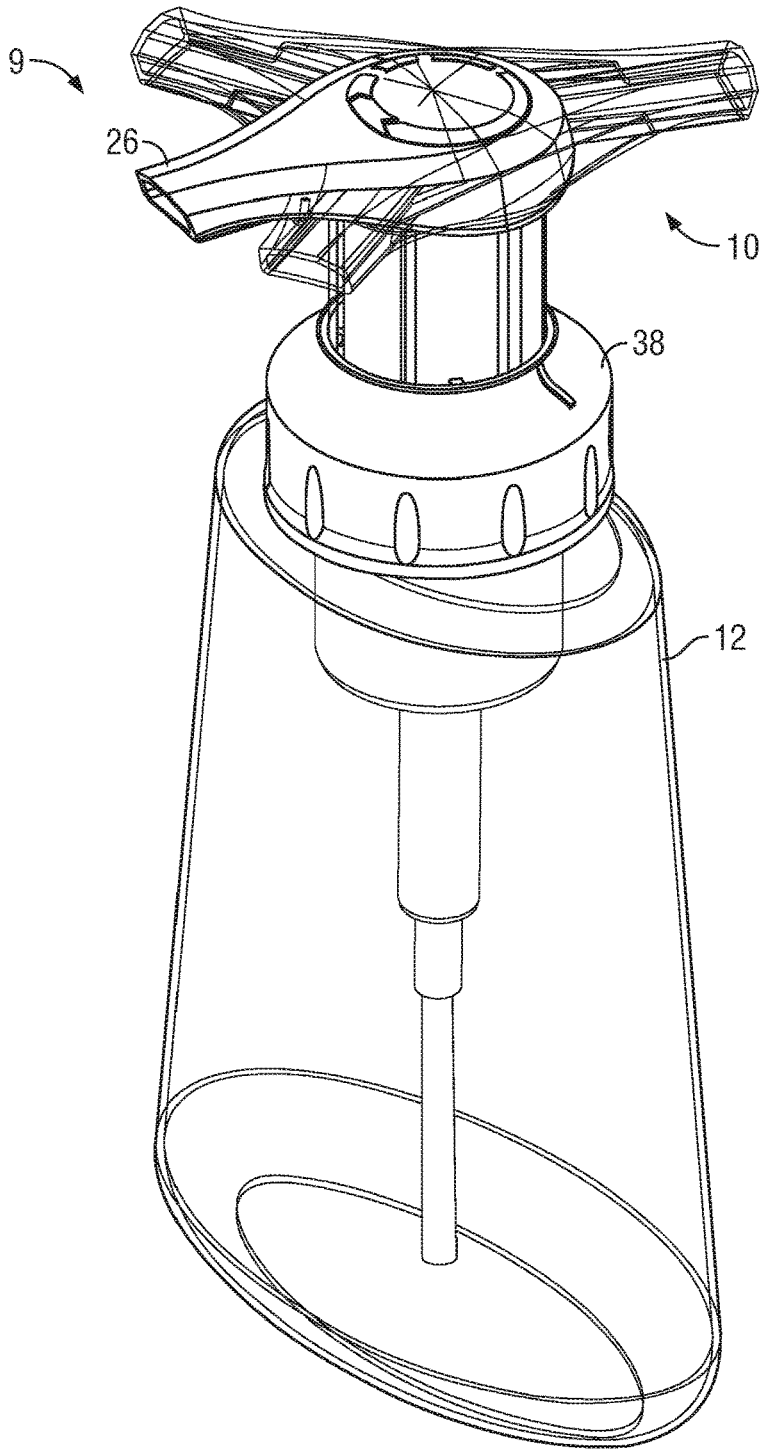
FIG. 27 is a perspective view of a fluid dispenser with a pump assembly in accordance with a fifth embodiment of the present invention in an unlocked extended position.

The actuator member 26 of FIG. 27 is substantially identical to the actuator member 26 described with reference to the first embodiment as illustrated, for example, in FIGS. 12 to 15 and notably in FIG. 15. In FIG. 15, the slide channel 70 has a circumferential extent between the channel side walls 206 and 208 selected to be of a circumferential extent C' only marginally greater than the circumferential extent C of the lug member 46 so as to constrain the lug member 46 to slide axially within the slide channel 70 in a purely axial direction relatively closely proximate to the channel side walls 206 and 208. Similarly, in FIG. 27, slide channel 70 is defined circumferentially between side wall 206 and side wall 208. However, in FIG. 27 the side walls 206 and 208 are spaced circumferentially an extent C''' substantially greater than the circumferential extent of the lug member 46. In the embodiment of FIG. 27, the slide walls 206 and 208 extend over the circumferential extent C''' greater than 270 degrees. As a result, when the actuator member 26 is coupled to the collar member 38 with the lug member 46 received within the slide channel 70, the actuator member 26 may be manually rotated relative the collar member 38 to a number of different rotational positions as schematically illustrated in FIG. 27.

Referring to FIG. 28, on FIG. 27, the stop slots 72 and the finger member 62 is identical to that shown in FIG. 15. In FIG. 15, the slide channel 70 has, in any cross-section normal to the axis 20, a constant cross-section axially to the inner slide tube end 50 of the slide tube 40, and thus axially through the end flange 202. The embodiment of FIG. 28 shows that it is not necessary that the side channel 70 extend through the end flange 202 or be open to the inner slide tube end 50. In FIG. 28, the slide channel 70 is at its axially inner end closed by end flange 202 and its stop shoulder 204. FIG. 28 continues to show the cut slots 55 as extending axially inwardly to the inner slide tube end 50. With the actuator member 26 as shown in FIG. 28, for assembly, the collar member 38 is assembled to the actuator member 26 sliding the lug member 46 axially outwardly into the stop slot 72 from which position by relative rotation of the actuator member 26, the lug member 46 may come to move past the finger member 62 to be located within the slide channel 70.

Figure 30:
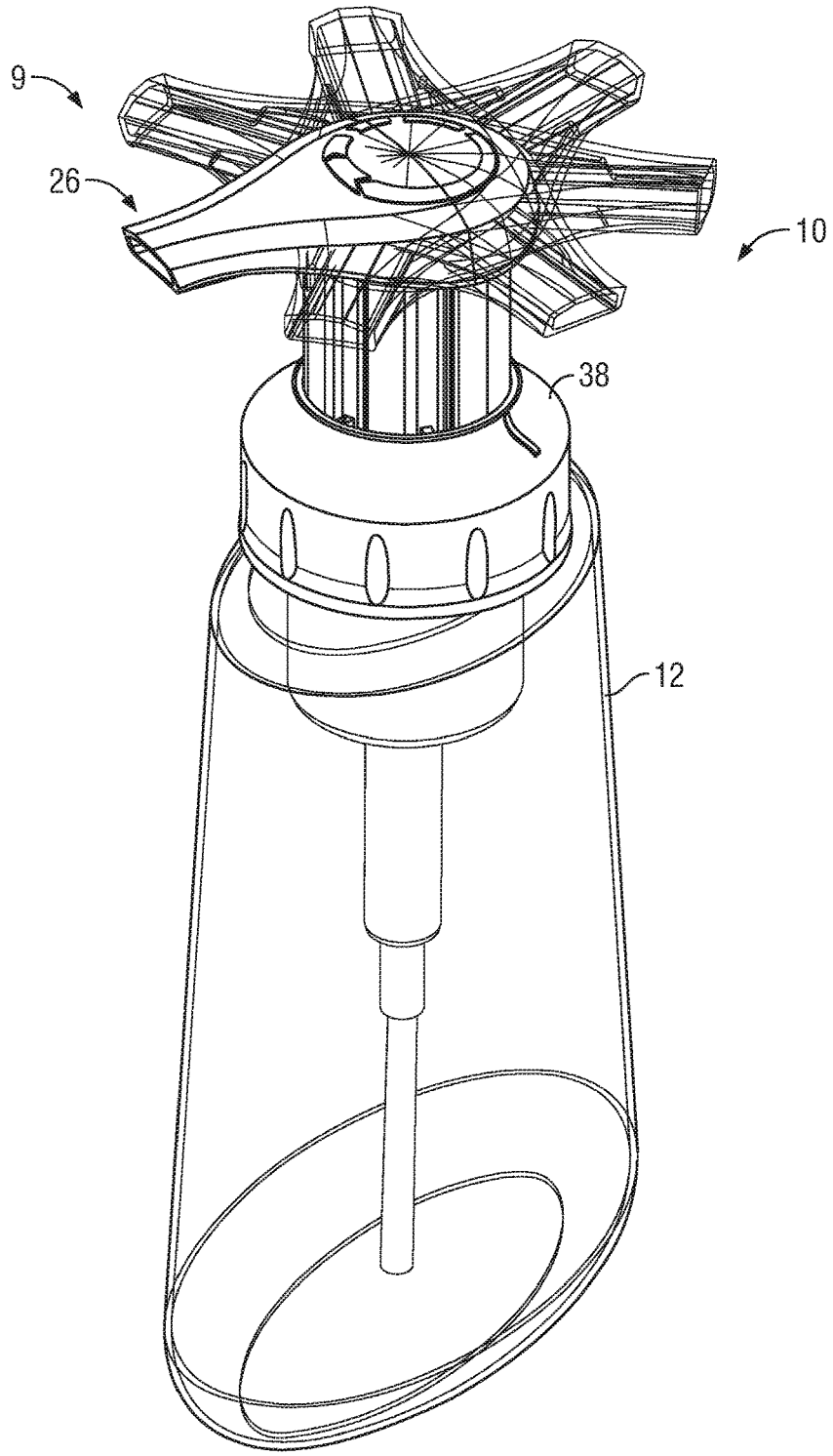
FIG. 30 is a perspective view of a fluid dispenser with a pump assembly in accordance with a sixth embodiment of the present invention in an unlocked extended position.
Figure 31:
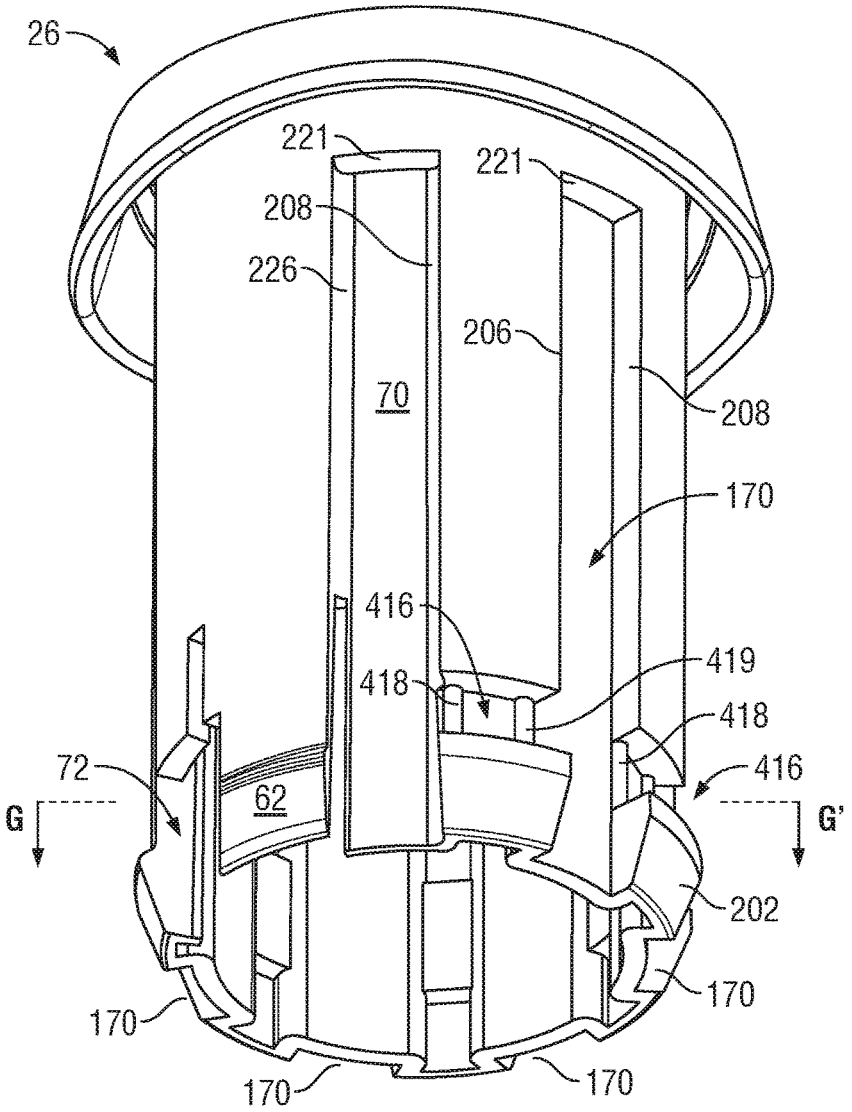
FIG. 31 is a pictorial rear view of the actuator member as seen from below for the sixth embodiment of the pump assembly and dispenser shown in FIG. 30.
Figure 32:
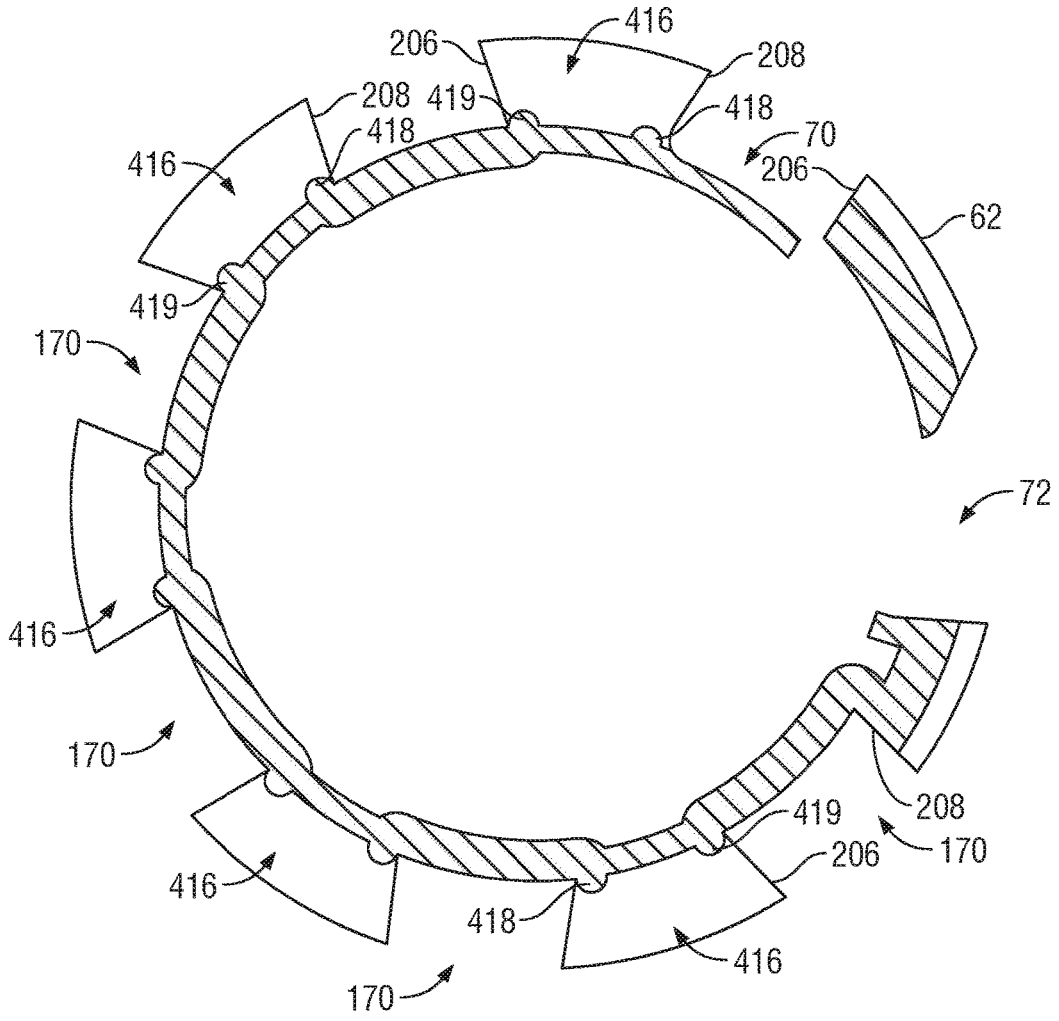
FIG. 32 is cross-sectional side view through FIG. 31 along section plane G-G.

Reference is made to FIGS. 30 to 32 which illustrate a sixth embodiment of a dispenser 9 and a pump 10 in accordance with the present invention. FIG. 31 is a pictorial view of an actuator member 26 for the pump 10 of the dispenser 9 in FIG. 30. Aside from the differences in the actuator member 26, the dispenser 9 and the pump 10 of FIG. 30 are preferably identical in their components to the dispenser 9 and pump 10 of the first embodiment of FIGS. 1 to 23. The actuator member 26 in FIG. 31 is substantially identical to the actuator member 26 in the first embodiment as shown, for example, in FIGS. 12 to 15 and notably in FIG. 15. Each of the actuator member 26 of FIG. 15 and the actuator member 26 of FIG. 31 have an identical stop slot 72, an identical finger member 62 and an identical slide channel 70. However, in the actuator member 26 of FIG. 31, five additional axially extending slide channels 170 are provided. Each of these side channels 170 similar to the slide channel 70 have channel side walls 206 and 208, a channel base 210, a base surface 211, and a channel inner end 210. Between the slide channel 70 and the slide channel 170 adjacent thereto, there is provided a circumferentially extending part annular slotway 416. When the actuator member 26 is biased by the spring 15 to the extended position relative to the collar member 38, the lug member 46 is axially aligned with the slotway 416. With the lug member 46 in the slide channel 70, clockwise rotation of the actuator member 26 relative to the collar member 38 urges the lug member 46 to pass circumferentially through the slotway 416 into the side channel 170. As can be seen in FIG. 31 and in cross-section in FIG. 32, each slotway 416 includes a pair of raised bosses 418 and 419 which prevent the lug member 46 from moving circumferentially through the slotway 416 unless a sufficient rotational force is applied to overcome the frictional interference between the lug member 46 and each boss 418. As can be seen in FIGS. 31 and 32, each pair of adjacent of the slide channels 170 are also connected to each other by a slotway 416. Thus, while the actuator member 26 is in the extended position, by appropriate rotation of the actuator member 26 relative to the collar member 38, the lug member 46 can be rotated to different operational rotational positions in which the lug member 46 is received in one of the side channel 70 and 170 in which in each the actuator member 26 is axially slidable relative to the collar member 38 for operation of the pump 10. The plurality of different operational rotational positions that the actuator member 26 can assume relative to the collar member 38 with the lug member 46 within one of the side channels 70 and 170 to permit operation of the pump 10 is schematically illustrated in FIG. 30.

Figure 33:
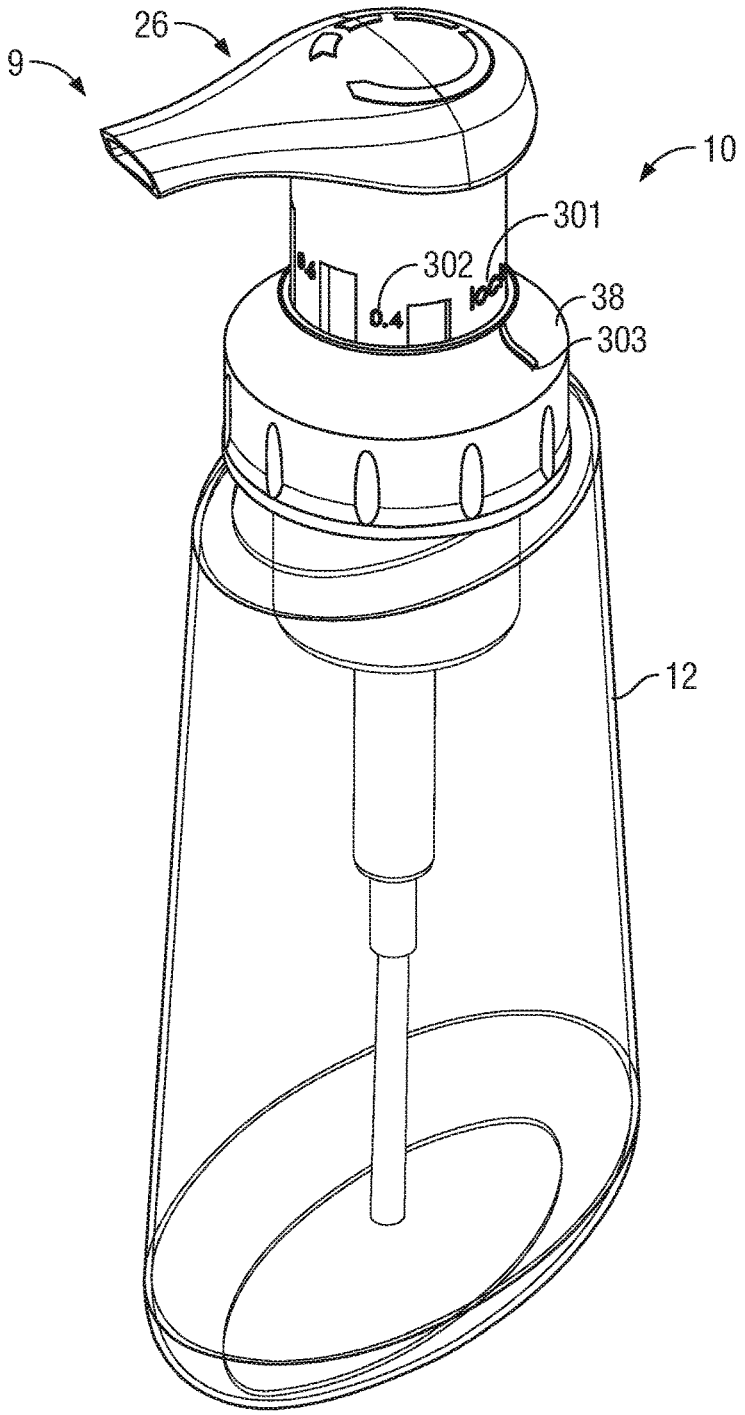
FIG. 33 is a perspective view of a fluid dispenser with a pump assembly in accordance with a seventh embodiment of the present invention in an unlocked extended position.
Figure 34:
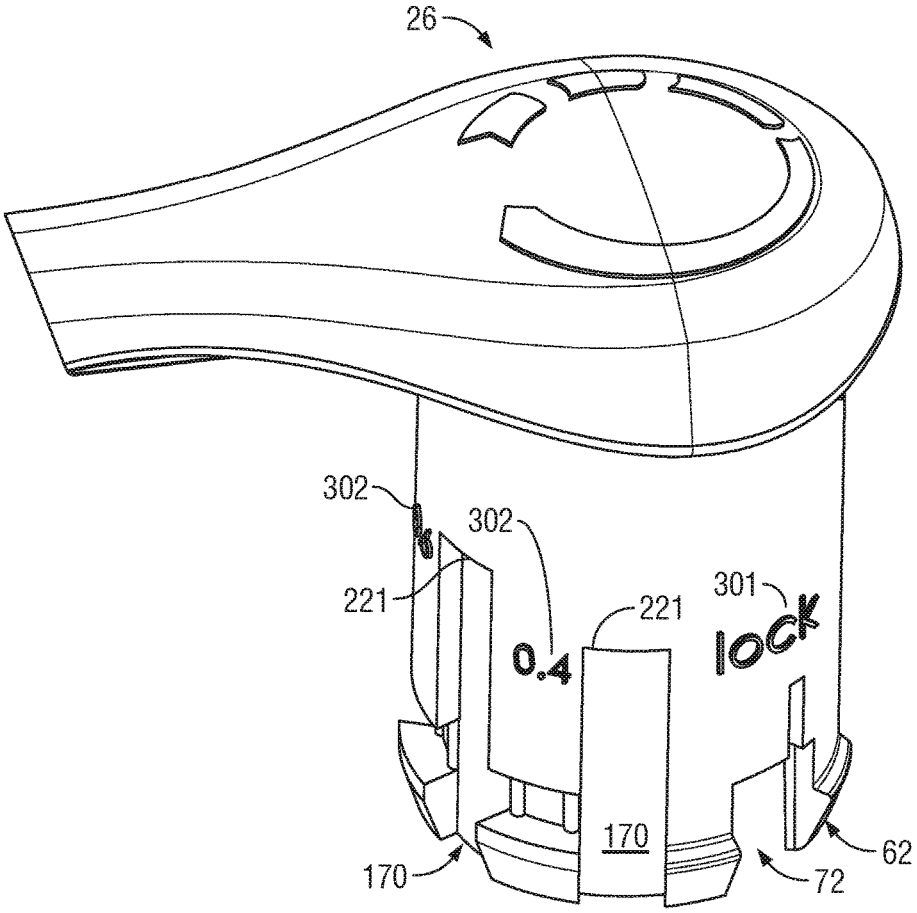
FIG. 34 is a pictorial right side view of the actuator member as seen from above for the seventh embodiment of the pump assembly and dispenser shown in FIG. 33.
Figure 35:
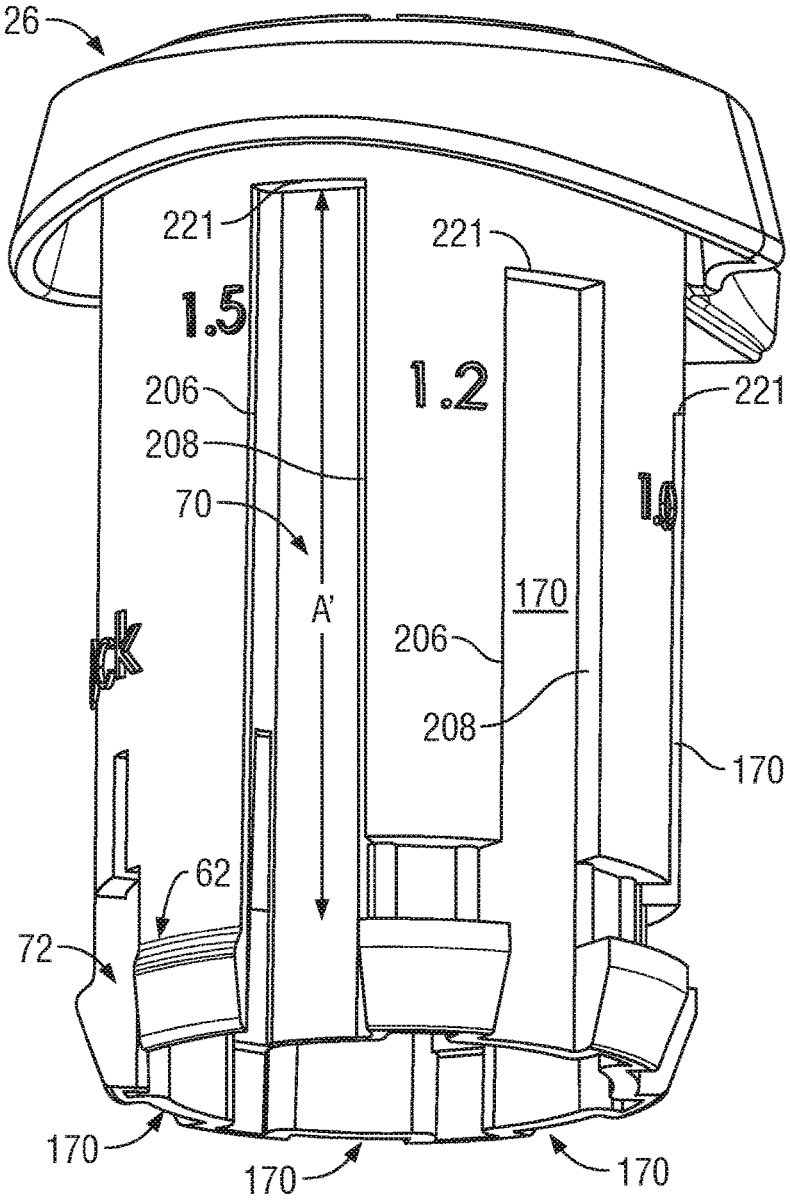
FIG. 35 is a pictorial rear view of the actuator member of FIG. 34 as seen from below.

Reference is made to FIG. 33 showing a pictorial view of dispenser 9 with a pump assembly in accordance with a seventh embodiment that has close similarities to the dispenser of the sixth embodiment in FIGS. 30 to 32. FIGS. 33 and 34 illustrate two different pictorial views of an actuator member 26 for the pump assembly 10 shown in FIG. 33. The actuator member 26 shown in FIGS. 33 and 34 is identical to the actuator member shown in FIGS. 31 and 32, however, with the first exception that each of the slide channels 70 and 170 have a different axial extent A'. When a lug member 46 is received in any one of the slide channels 70 and 170 in FIGS. 33 and 34, then the axial length of the stroke of the piston-forming element 16 relative to the piston chamber-forming body 14 is limited by the location of the respective axially outer end wall 221 of each of the slide channels 70 and 170. These different lengths of strokes for reciprocal movement of the piston-forming element 16 provides in each cycle of operation in moving the piston-forming element 16 between an extended position and a retracted position for the discharge of different volumes of liquid for the respective different slide channels 70 and 170. As a second exception, the actuator member 26 in FIGS. 33 to 35 is provided with volume indicia 300 for each of the slide channels 70 and 170 to indicate to the user the relative volume to be dispensed when the actuator member 26 is rotated to a position in line with one of the slide channels 70 and 170. Preferably, indicia 301 is also provided on the actuator member 26 to indicate to the user a locked position.

The indicia 300 and 301 are located on the actuator member 26 to be visible to a user when the actuator member 26 is in extended operation positions such as shown in FIG. 35. Preferably, an indicator 303 is provided on the collar member 38 to indicate when the relative rotational position of the actuator member 26 on the collar member 38 corresponds to one of the indicia 300 and 301. For example, as seen on FIG. 33 showing a pictorial view of a dispenser 9 in accordance with the seventh embodiment, the indicator 303 provides an indication that the actuator member 26 is in an inoperative locked position by reason of the indicator 303 being axially aligned with the indicia 301. By an appropriate manipulation of the actuator member 26 to rotate from the locked configuration to an unlocked configuration, the indicator 303 on the collar member 38 will come to be aligned with an appropriate one of the slide channels 70 and 170 with the indicia 301 for that slide channel being visible to the user.

The pump assembly 10 illustrated in the first embodiment provides for the simultaneous dispensing of air and liquid through a foam generator 25 to produce a foam product. The configuration of the pump is, however, also suitable for simultaneous dispensing of air and liquid as a spray or mist in which case the foam generator 25 would not be provided and a suitable nozzle for producing a desired spray of the air and the liquid would be provided.

In accordance with the preferred embodiments, the pump assembly includes a liquid pump or both a liquid pump and an air pump. Of course, other arrangements could be embodied which is merely an air pump. Each of the liquid pump and air pump are shown to be piston pumps. In each of the liquid pump and air pump shown, discharge is provided in a retraction stroke. The particular nature of the piston pumps illustrated by the liquid pump and the air pump may, however, be substituted by other constructions for liquid pumps and air pumps which may, for example, discharge fluid in a withdrawal stroke. However, it is to be appreciated that the invention that arises in respect of the interaction of the lug member 46 with motion control features on the guide tube 48 can be adopted for various arrangements in which a piston element is to be constrained in its ability to relatively slide axially and rotate relative to a piston chamber-forming body.

The preferred embodiments of the liquid pump provide a separate one-way inlet valve 17. It is known to a person skilled in the art by various configurations of stepped chambers that a liquid piston pump can be provided without the need for a separate one-way valve. In accordance with the present invention, the pump provides for simultaneous discharge of air and liquid in which the liquid pump and the air pump operate in sequence, that is, dispensing simultaneously in a retraction stroke. It is to be appreciated that in accordance with various liquid pumps and air pumps which may be desired to be utilized, the liquid pump may be out of phase with the air pump in the sense of the liquid pump discharging liquid into the air compartment during one stroke and the air pump discharging air and the liquid received from the liquid pump in another stroke.

The preferred embodiment illustrates a pump assembly in which each of the components forming the pump are preferably formed as by injection molding from plastic materials and to provide for ease of manufacture from a minimal number of components. The piston chamber-forming body 14 is shown as being illustrated principally from two components, namely, the tube member 36 and the collar member 38. It is to be appreciated that these two components could possibly be injection molded as a single component, however, this would increase the complexity of the molds required for manufacture.

In accordance with the preferred embodiments, the pump assemblies are adapted for use in a dispenser which preferably is a bottle top dispenser in which the fluid is dispensed upwardly. This is not necessary and, in accordance with the present invention, pump assemblies could be developed which utilize similar lug members and motion controlling features yet permit dispensing of the fluid downwardly for in other orientations such as horizontally. Modifications of the liquid and/or air pumps can be made to facilitate the direction that fluid needs to be moved yet still use a similar interaction of the lug member and motion controlling features. In the preferred embodiments illustrated, for example, in FIG. 1, the dispenser 9 is adapted to be placed on a support surface such as a table and as such a tabletop dispenser is preferably adapted for dispensing hand cleaning fluid from hand cleaning disinfectants and hand cleaning creams.

While the invention has been described with reference to preferred embodiments, many modifications and variations will now occur to persons skilled in the art. For definition of the invention, reference is made to the follow claims.

We claim:

1. A pump assembly for dispensing a liquid from a container comprising:

a piston chamber-forming body having a cylindrical fluid chamber disposed about an axis and open at an axially outer end, a piston-forming element comprising a piston member and an actuator member, the piston member extending from the actuator member coaxially inwardly through the outer end of the fluid chamber into the fluid chamber and engaging the fluid chamber to form a liquid pump, the piston-forming element including a central axially extending stem with a passageway therethrough for passage of the liquid discharged by the liquid pump axially outwardly to a discharge outlet on the actuator member axially outwardly of the piston chamber-forming body, wherein in coaxial reciprocal movement of the piston-forming element relative the piston chamber-forming body about the axis between a retracted axial position and an extended axial position the liquid pump dispenses liquid from the container out the discharge outlet, the piston chamber-forming body including a collar member for engagement with an opening of the container, the collar member having an inner guide tube coaxially about the axis open at both an axially inner end and an axial outer end, the guide tube having a cylindrical radially inwardly directed inner guide surface, a lug member extending radially inwardly from the inner guide surface, the lug member extending radially inwardly from the inner guide surface over a circumferential extent C, a radial extent R, and an axial extent A, the piston-forming element having an outer slide tube fixed to the actuator member at an axially outer end and extending axially inwardly to an open axial inner slide tube end, the slide tube coaxially about the piston member radially outwardly about the piston member, the slide tube having a radially outwardly directed outer tubular slide tube wall, a pair of axially extending circumferentially spaced cut slots each cut radially through the slide tube wall from a respective inner slot end open to the inner slide tube end to a respective blind outer slot end located spaced axially outwardly from the inner slide tube end, a first finger member defined in the slide tube wall between the cut slots with the first finger member extending from an axially inner distal end of the first finger member to an axially outer end of the first finger member where the first finger member merges into the slide tube wall between the outer slot ends, the first finger member deflectable by radially inwardly directed forces to move the distal end radially inwardly relative the slide tube wall, the slide tube having an axially extending first slide channel extending radially inwardly from the slide tube wall, the first slide channel and the lug member complementarily sized in circumferential extent and radial extent such that when the slide tube is rotated about the axis relative the guide tube to a first operative rotational position the lug member slides axially in the first side channel permitting relative coaxial sliding between the retracted position and the extended position for operation of the liquid pump to dispense the liquid, the slide tube having an axially extending first stop slot extending radially inwardly into the slide tube wall, the first stop slot and the lug member complementarily sized in circumferential extent and radial extent such that when the slide tube is rotated about the axis relative the guide tube to a first inoperative rotational position the lug member is received in the first stop slot and engagement between the slide tube and the guide tube limits relative coaxial sliding to prevent operation of the liquid pump to dispense the liquid, the first finger member located on the slide tube circumferentially between the first slide channel and the first stop slot, in relative rotation of the guide tube and the slide tube about the axis from the first inoperative rotational position to the first operative rotational position the first finger member blocks the circumferential movement of the lug member until with relative rotation about the axis a camming surface of the lug member and a cammed surface on the first finger member engage deflecting the first finger member radially inwardly out of the path of the lug member permitting the lug member to rotate circumferentially therepast from the first inoperative rotational position to the first operative rotational position.

2. A pump assembly as claimed in claim 1 wherein the piston-forming element carrying a finger stopping surface located radially inwardly from the first finger member limiting radial inward deflection of the first finger member.

3. A pump assembly as claimed in claim 2 wherein on radially inward deflection of the first finger member the finger stopping surface located radially inwardly from the first finger member is engaged by the first finger member and increases the resistance to deflecting the first finger member radially inwardly out of the path of the lug member.

4. A pump assembly as claimed in claim 3 wherein the finger stopping surface is resilient having an inherent bias to assume an inherent position and when deflected from the inherent position returns to the inherent position, the finger stopping surface located radially inwardly from the first finger member is engaged by the first finger member and resiliently biases the first finger member radially outwardly.

5. A pump assembly as claimed in claim 2 wherein the finger stopping surface is carried on the stem of the piston forming element.

6. A pump assembly as claimed in claim 5 wherein the finger stopping surface comprises a cylindrical radially outwardly directed surface of the stem coaxial about the axis.

7. A pump assembly as claimed in claim 1 wherein when the slide tube is in the first inoperative rotational position with the lug member received in the first stop slot, engagement between an axially outwardly directed stop surface on the lug member and an axially inwardly directed stop surface on the guide tube limits relative coaxial sliding of the slide tube axially inwardly relative the guide tube.

8. A pump assembly as claimed in claim 7 wherein when the slide tube is in the first inoperative rotational position with the lug member received in the first stop slot, engagement between an axially outwardly directed stop surface on the lug member and the axially inwardly directed stop surface on the guide tube limits relative coaxial sliding of the slide tube axially inwardly relative the guide tube at an inner axial stop position not farther axially outward then the retracted position.

9. A pump assembly as claimed in claim 8 wherein the first slide channelway includes a stop wall that engages the lug member while in the slide channelway to prevent rotation of the slide tube relative the guide tube from the first operative rotational position to the first inoperative rotational position unless the piston-forming element is axially positioned relative the piston chamber-forming body between the retracted axial position and the inner axial stop position.

10. A pump assembly as claimed in claim 9 wherein the lug member is carried at an axial location on the guide tube, and the first finger member is carried on the slide tube at an axial location whereby when the piston-forming element is in or between the retracted axial position and the inner axial stop position with relative rotation of the guide tube and slide tube about the axis the camming surface of the lug member and the cammed surface on the first finger member engage to deflect the first finger member radially inwardly out of the path of the lug member permitting the lug member to rotate circumferentially therepast from the first inoperative rotational position to the first operative rotational position.

11. A pump assembly as claimed in claim 1 wherein:

the inner slide tube end carries a radially outwardly extending stop flange member with an axially outwardly directed stop surface, the stop flange member located axially inwardly of the axially inner end of the guide tube to engage an axially inwardly directed stop surface on the axially inner end of the guide tube to limit axial outward movement of the slide tube in the guide tube in the extended position.

12. A pump assembly as claimed in claim 1 wherein the first slide channel includes a stop wall that engages the lug member to prevent rotation from the first operative rotational position once the lug member is in the first slide channel.

13. A pump assembly as claimed in claim 12 wherein:

the first slide channel includes a stop wall that engages the lug member while the lug member is in the first slide channel to prevent rotation from the first operative rotational position to the first inoperative rotational position unless the piston-forming element is axially positioned relative the piston chamber-forming body between the retracted axial position and the inner axial stop position.

14. A pump assembly as claimed in claim 1 wherein the actuator member carrying at an axially outer end an axially outwardly directed engagement surface for the application of manual forces to move the piston forming element towards the retracted position.

15. A pump assembly as claimed in claim 14 wherein a spring member disposed between the piston chamber-forming body and the piston-forming element biasing the piston-forming element to the extended position, the actuator member includes a radially extending discharge tube with the discharge outlet at a radially outer end and an internal passage directing the liquid from the passageway in the stem radially outwardly to the discharge outlet.

16. A pump assembly as claimed in claim 1 wherein:

a pair of axially extending circumferentially spaced second cut slots each cut radially through the slide tube wall from a respective inner slot end open to the inner slide tube end to a respective blind outer slot end located spaced axially outwardly from the inner slide tube end, a second finger member defined in the slide tube wall between the second cut slots with the second finger member extending from an axially inner distal end of the second finger member to an axially outer end of the second finger member where the second finger member merges into the slide tube wall between the outer slot ends, the second finger member deflectable by radially inwardly directed forces to move the distal end radially inwardly relative the slide tube wall, the slide tube having an axially extending second slide channel extending radially inwardly from the slide tube wall, the second slide channel and the lug member complementarily sized in circumferential extent and radial extent such that when the slide tube is rotated about the axis relative the guide tube to a second operative rotational position the lug member slides axially in the second side channel permitting relative coaxial sliding between the retracted position and the extended position for operation of the liquid pump to dispense the liquid, the second finger member located on the slide tube circumferentially adjacent the second slide channel adjacent the first stop slot on an opposite circumferential side of the first stop slot than the first slide channel, in relative rotation of the guide tube and the slide tube about the axis from the first inoperative rotational position to the second operative rotational position the second finger member blocks the circumferential movement of the lug member until with relative rotation about the axis the camming surface of the lug member and a cammed surface on the second finger member engage deflecting the second finger member radially inwardly out of the path of the lug member permitting the lug member to rotate circumferentially therepast from the first inoperative rotational position to the second operative rotational position.

17. A pump assembly as claimed in claim 1 wherein:

the slide tube having an axially extending second stop slot extending radially inwardly from the slide tube wall, the second finger member located on the slide tube circumferentially between the second slide slot and the first stop slot, and on an opposite circumferential side of the first stop slot than the first slide channel, the second stop slot and the lug complementarily sized in circumferential extent and radial extent such that when the slide tube is rotated about the axis relative the guide tube to a second inoperative rotational position the lug member is received in the second stop slot and engagement between the slide tube and the guide tube limits relative coaxial sliding to prevent operation of the liquid pump to dispense the liquid.

18. A pump assembly as claimed in claim 1 wherein:

the inner slide tube end carries a radially outwardly extending stop flange member with an axially outwardly directed stop surface, the stop flange member located axially inwardly of the axially inner end of the guide tube to engage an axially inwardly directed stop surface on the inner end of the guide tube to limit axial outward movement of the slide tube in the guide tube in the extended position.

19. A pump assembly as claimed in claim 1 wherein:

the lug member carried at an axial location on the guide tube, and the first finger member carried on the slide tube at an axial location whereby when the piston-forming element is in the retracted axial position.

20. A pump assembly as claimed in claim 1 wherein:

the piston chamber-forming body having a cylindrical air chamber disposed about the axis having an axially inner end and an axially outer end, the axially outer end of the liquid chamber opening into the air chamber, the piston member extending from the actuator member coaxially inwardly through the outer end of the air chamber into the fluid chamber, the piston member and engaging the air chamber to form an air pump for discharge of air into the passageway of the stem for simultaneous passage of the liquid discharged by the liquid pump and the air discharged by the air pump axially outwardly to the discharge outlet, wherein in coaxial reciprocal movement of the piston-forming element relative the piston chamber-forming body about the axis between a retracted axial position and an extended axial position, the liquid pump dispenses liquid from the container out the discharge outlet and the air pump discharges air out the discharge outlet.

* * * * *